US005582960A

United States Patent [19]

Nielsen et al.

[11] Patent Number: 5,582,960

[45] Date of Patent: Dec. 10, 1996

[54] PHOTOGRAPHIC PRINT MATERIAL

[75] Inventors: Ralph B. Nielsen; Scott F. Odell; John L. Pawlak, all of Rochester, N.Y.

[73] Assignee: Eastman Kodak Company, Rochester, N.Y.

[21] Appl. No.: 390,442

[22] Filed: Feb. 17, 1995

[51] Int. Cl.[6] ..... G03C 1/08

[52] U.S. Cl. ..... 430/508; 430/583; 430/556; 430/557; 430/567; 430/546; 430/631; 430/570; 430/581

[58] Field of Search ..... 430/503, 508, 430/556, 557, 567, 543, 546, 631, 570, 581, 583

[56] References Cited

U.S. PATENT DOCUMENTS

| | | | |
|---|---|---|---|
| 2,772,163 | 11/1956 | Tong | 96/97 |
| 2,852,382 | 9/1958 | Illingsworth et al. | 96/97 |
| 3,619,195 | 11/1971 | Van Campen | 96/100 |
| 3,847,613 | 11/1974 | Sakazume et al. | 96/74 |
| 4,199,363 | 4/1980 | Chen | 430/512 |
| 4,203,716 | 5/1980 | Chen | 430/207 |
| 4,232,118 | 11/1980 | Okauchi et al. | 430/574 |
| 4,304,769 | 12/1981 | Chen | 424/218 |
| 4,358,533 | 11/1982 | Tokitou et al. | 430/512 |
| 4,368,258 | 1/1983 | Fujiwhara et al. | 430/493 |
| 4,388,403 | 6/1983 | Helling et al. | 430/546 |
| 4,469,785 | 9/1984 | Tanaka et al. | 430/572 |
| 4,490,461 | 12/1984 | Webb et al. | 430/510 |
| 4,518,689 | 5/1985 | Noguchi et al. | 430/574 |
| 4,675,352 | 6/1987 | Winter et al. | 524/91 |
| 4,724,197 | 2/1988 | Matejec et al. | 430/377 |
| 4,822,728 | 4/1989 | Loiacono et al. | 430/551 |
| 4,840,885 | 6/1989 | Peters et al. | 430/559 |
| 4,857,449 | 8/1989 | Ogawa et al. | 430/546 |
| 4,891,309 | 1/1990 | Uesawa et al. | 430/627 |
| 4,914,005 | 4/1990 | Lau et al. | 430/377 |
| 4,916,050 | 4/1990 | Nishijima et al. | 430/546 |
| 4,927,743 | 5/1990 | Tamoto | 430/496 |
| 4,939,077 | 7/1990 | Helling et al. | 430/527 |
| 4,946,770 | 8/1990 | Takahashi et al. | 430/545 |
| 4,990,435 | 2/1991 | Vallarino et al. | 430/546 |
| 5,001,045 | 3/1991 | Furutachi et al. | 430/545 |
| 5,026,631 | 6/1991 | Yoneyama | 430/545 |
| 5,037,728 | 8/1991 | Shiba et al. | 430/505 |
| 5,047,315 | 9/1991 | Morigaki et al. | 430/544 |
| 5,047,316 | 9/1991 | Hirano et al. | 430/545 |
| 5,055,386 | 10/1991 | Hirano et al. | 430/545 |
| 5,071,738 | 12/1991 | Mizukura et al. | 430/546 |
| 5,077,188 | 12/1991 | Tanji et al. | 430/546 |
| 5,091,296 | 2/1992 | Bagchi et al. | 430/546 |
| 5,100,771 | 3/1992 | Mihayashi et al. | 430/546 |
| 5,180,657 | 1/1993 | Fukazawa et al. | 430/503 |
| 5,206,124 | 4/1993 | Shimazaki et al. | 430/505 |
| 5,242,788 | 9/1993 | Takahashi et al. | 430/558 |
| 5,252,444 | 10/1993 | Yamada et al. | 430/503 |
| 5,270,354 | 12/1993 | Vermeersch et al. | 523/334 |
| 5,278,037 | 1/1994 | Karino | 430/513 |
| 5,279,931 | 1/1994 | Bagchi et al. | 430/449 |
| 5,294,527 | 3/1994 | Deguchi | 430/545 |
| 5,300,417 | 4/1994 | Lushington et al. | 430/536 |
| 5,370,983 | 12/1994 | Shono et al. | 430/546 |
| 5,434,038 | 7/1995 | Bohan et al. | 430/503 |

FOREIGN PATENT DOCUMENTS

| | | |
|---|---|---|
| 606178 | 10/1960 | Canada . |
| 324476 | 7/1989 | European Pat. Off. . |
| 483416 | 5/1992 | European Pat. Off. . |
| 586974 | 3/1994 | European Pat. Off. . |
| 60/140344 | 7/1985 | Japan . |
| 62/178965 | 8/1987 | Japan . |
| 1287013 | 8/1972 | United Kingdom . |

OTHER PUBLICATIONS

Abstract for Japanese Patent Application 58/149038.

Research Disclosure, Jul. 1980; Item 19551, entitled "Use of Latices In Photographic Elements".

Research Disclosure, Jun. 1994; Item 36216, entitled "Photographic Multilayer Elements".

*Primary Examiner*—Geraldine Letscher

*Attorney, Agent, or Firm*—Andrew J. Anderson

[57] ABSTRACT

An improved image display material comprising high chloride silver halide emulsions having greater than 90 mole % silver chloride, where the material comprises a yellow dye-forming layer sensitive to blue light comprising a high chloride silver halide emusion with a peak spectral sensitivity to blue light less than about 475 nm, preferably from about 440–475 nm, and a coupler dispersion comprising a yellow dye-forming coupler and a water-insoluble polymer. Photographic image display materials with both short-blue sensitivity and a polymer dispersion in the yellow dye-forming blue-sensitive layer show a synergistic improvement in color reproduction in accordance with the invention, providing for color photographic prints with less color error than seen for materials comprising only one of the components. The improvement is most notable for yellow and green colored areas of a color print.

19 Claims, No Drawings

PHOTOGRAPHIC PRINT MATERIAL

FIELD OF THE INVENTION

The present invention relates to a photographic image display material for making color photographic prints, such as color paper photographic prints, with improved color reproduction. More particularly, it relates to a negative-working color image display material with high chloride silver halide emulsions with a particular spectral sensitivity to blue light and particular components in a blue light sensitive layer which provide improved color reproduction attributes to the material.

BACKGROUND OF THE INVENTION

Color reproduction is an important factor in the design of color photographic image display materials. Most photographic image display materials, or print materials, are negative-working photographic elements that are exposed by projecting a negative film image onto the print material, with the yellow, magenta, and cyan components of the negative image mediating the blue, green, and red exposure of the print material. Color print materials with silver halide emulsions that are predominantly silver chloride are most useful. Photographic elements in which the emulsions comprise at least 90% silver chloride, and preferably at least 95% silver chloride are most desirable, with less than about 2.0 mole % of iodide, and less than about 5.0 mole % bromide being particularly desirable. Such high chloride emulsions offer several advantages. Perhaps most important to color reproduction is that silver chloride emulsions have essentially no native sensitivity to blue light, unlike silver chlorobromide emulsions that were once commonly used in print materials. For this reason, the blue spectral sensitivity of silver chloride emulsions can be controlled primarily by the choice of sensitizing dyes. Other advantages of silver chloride emulsions include rapid development, ease of bleaching and fixing, and decreased risk of environmental contamination.

Currently commercially available silver chloride color print materials have a near-maximum blue sensitivity to light with a wavelength of about 480 nm. In most cases with chloride emulsions, a single blue sensitizing dye with relatively narrow absorption is used as a sensitizer, so that sensitivity of the emulsion to blue light of much longer or much shorter wavelengths decreases sharply in either direction from the peak sensitivity. Silver bromochloride emulsions with substantial bromide content (for instance, greater than 50% bromide) have a much broader envelope of sensitivity to blue light. Additionally, some silver chloride print materials use more than one sensitizing dye, for instance with one dye that gives a peak sensitivity near 480–485 nm, and another between 475–480 nm.

One reason why most silver chloride emulsions for color paper are sensitized near 480 nm is that such sensitization can help provide adequate blue print speed. Blue print speed, or the exposure time required for exposing the blue-sensitive emulsion, depends on several components, including the spectral distribution of energy from the printer lamp, any lamphouse filtration or other filtration of blue light in the printer, the blue density of the imaging dyes, masking couplers, or other blue density components in the negative being printed, and the spectral distribution of sensitivity in the print material. Many lamps in printers are tungsten sources, that are deficient in blue light relative to red or green light. Tungsten lamps also emit more blue light at 480 nm than at shorter wavelengths. Also, many of the blue density components in the negative have peak absorption of blue light near 440–450 nm. For these reasons, typical silver chloride emulsions with a narrow sensitivity near 480 nm will have faster blue print speed than emulsions with a narrow sensitivity at shorter wavelengths, where the printer lamp emits less energy, and the blue-absorbing components of the negative have a higher density. Emulsions with broader sensitivity will also have higher print speed, including silver chlorobromide emulsions, and silver chloride emulsions with multiple sensitizing dyes with differing peak sensitivities.

Another reason why silver chloride color papers have peak blue sensitivity near 480 nm is the commercial need to maintain compatibility between different brands of color negative originating films, different offerings of these color films from a common manufacturer, and different brands and types of printing equipment and printing materials. Films are formulated such that a neutral exposure scale will eventually result in a neutral print, with neutrality of the scale preserved from low to high density. The contrast attributes and spectral sensitivity of both commercial films and papers affect this. The established commercial product relationships can help explain why blue-sensitive emulsions in AgCl color print papers all have high sensitivity near 480 nm.

It has recently been discovered that spectral sensitization of blue-sensitive emulsions in print materials with predominantly AgCl emulsions, to give a narrow, peak sensitivity of from about 440 to 475 nm, more preferably less than 470 nm, and even more preferably less than 460 nm, causes several desirable effects on the printed tone scale and color reproduction, as discussed in co-pending, commonly assigned U.S. patent application Ser. No. 08/220,989 by Bohan et al., entitled "Improved Photographic Image Display Material and Method of Printing" filed Mar. 31, 1994, the disclosure of which is hereby incorporated by reference in its entirety. In particular, because the peak blue sensitivity in such materials may be separated from the peak green sensitivity by more than about 75 nm, better color separation is seen for colors generated by blue and green exposures. Also, a higher printed blue contrast is observed, giving yellow and green colors, particularly, with higher saturation. A contributing factor to this effect is the better overlap of yellow image dye light absorption in the printed negative with the sensitivity of the hypsochromically sensitized emulsion in the print material. Such predominantly silver chloride emulsions with hypsochromic peak blue sensitivity of from about 440 to 475 nm, and a relatively narrow sensitivity, will hereinafter be referred to as short-blue sensitive emulsions.

The overall color reproduction of a print material is affected by the nature of the dye-forming components as well as the spectral sensitivity of the silver halide emulsions. Commonly, the yellow dye-forming photographic couplers in silver-halide print materials are acylacetanilide compounds. Many such acylacetanilide couplers, when combined with short-blue sensitive emulsions, provide images with higher saturation or print-through contrast, as expected, but also with a visually objectionable increase in the unwanted absorption of green light in yellow and/or green areas of the print. For example, this would make a yellow object appear somewhat orange.

Polymer containing dispersions of yellow photographic couplers have been employed in color print materials, as described in U.S. Pat. No. 4,857,449. Other methods for preparing polymer-containing dispersions of dye-forming couplers are described in U.S. Pat. Nos. 4,939,077; 4,203, 716; and 4,840,885. Commonly, these dispersions are prepared from a solution of a coupler, an optional high-boiling solvent, an oil-soluble but water-insoluble polymer, and a volatile organic solvent, which solution is then emulsified and dispersed in an aqueous solution, often comprising water, a hydrophilic colloid such as gelatin, and a surfactant. Other methods describe the formation of loaded latex polymer dispersions using water-miscible or volatile organic solvent. A main advantage of polymer-containing dispersions described in the prior art relates to image preservability to heat and light, although other advantages in manufacturing processes, physical performance of the photographic element, and sensitometric performance have been reported. There has been no previous suggestion, however, to use polymer containing dispersions of yellow dye-forming photographic couplers in combination with short-blue sensitive high-chloride emulsions for improved color reproduction.

PROBLEMS TO BE SOLVED

It is an object of the invention to provide photographic image display materials for making color photographic prints with improved color reproduction attributes compared to prior art materials. It is a further object of the invention to provide such elements having sufficient speed to be efficiently printed.

SUMMARY OF THE INVENTION

With the present invention, we have discovered that color photographic prints with the attribute of improved color accuracy can be prepared from a negative-working silver halide photographic image display material comprising high chloride silver halide emulsions having greater than 90 mole % silver chloride, where the material comprises a yellow dye-forming layer sensitive to blue light comprising a high chloride silver halide emusion with a peak spectral sensitivity to blue light less than about 475 nm, preferably from about 440–475 nm, more preferably from about 450–470 nm, and even more preferably from about 450–460 nm, and a coupler dispersion comprising a yellow dye-forming coupler and a water-insoluble polymer. Photographic image display materials with both short-blue sensitivity and a polymer dispersion in the yellow dye-forming blue-sensitive layer show a synergistic improvement in color reproduction in accordance with the invention, providing for color photographic prints with less color error than seen for materials comprising only one of the components. The improvement is most notable for yellow and green colored areas of a color print.

DETAILED DESCRIPTION OF THE INVENTION

The invention will now be described in greater detail. Red or red light generally means actinic radiation or light of a wavelength of between about 600 and 750 nm, green or green light generally means light of a Wavelength between about 500 and 600 nm while blue or blue light generally means light have a wavelength of between about 400 and 500 nm. In the same vein, dyes which primarily absorb red light are referred to as cyan dyes, dyes which primarily absorb green light are referred to as magenta dyes and dyes which primarily absorb blue light are referred to as yellow dyes. Unless otherwise indicated, dye densities are reported as Status M densities the measurement of which is described at T. H. James, Ed., "The Theory of the Photographic Process," Macmillan, New York, 1977, 4th edition, pages 520–521.

The term photographic image display material includes any light sensitive photographic material suitable for direct viewing by reflected light such as a color photographic paper or direct viewing by transmitted light such as a color photographic advertising transparency.

Most generally, these photographic display materials will comprise a red light sensitive color record capable of forming a cyan dye deposit, a green light sensitive color record capable of forming a magenta dye deposit and a blue light sensitive color record capable of forming a yellow dye deposit. The red light color record will typically have a peak sensitivity at about 700 nm, and the green light color record will typically have a peak sensitivity at about 550 nm. The peak sensitivity of the blue light color record useful in the practice of the current invention will be discussed in detail below. The dye deposits will typically be formed during a development step which comprises contacting the display material with a basic solution and a paraphenylene diamine development agent to reduce silver halide to silver metal with concomitant production of an oxidized form of color developer. This oxidized color developer in turn reacts with a photographic coupler to form the chromogenic cyan, magenta and yellow dye images, all as known in the art. The coupler may be introduced into the material during processing but is preferably present in the material before exposure and processing. The couplers may be monomeric or polymeric in nature. The development step may be amplified by the presence of peroxides as known in the art. The display material may then be optionally desilvered using any technique known in the art. The display image may be borne on a reflective support, such as that used in color papers or on a transparent support such as that used in projection display materials. The components, assembly and processing of color photographic display materials are described in detail at *Research Disclosure* Item 17643, 1978; Item 18716, 1979; and Item 308119, 1989, all published by Kenneth Mason Publications, Ltd., The Old Harbormaster's 8 North Street, Emsworth, Hampshire P010 7DD, England, the disclosures of which are incorporated by reference. Materials and methods useful in the preparation of color photographic display materials are additionally described at T. H. James, Ed., "The Theory of the Photographic Process," Macmillan, New York, 1977; "The Kirk-Othmer Encyclopedia of Chemical Technology," John Wiley and Sons, New York, 1993; Neblette's "Imaging Processes and Materials," Van Nostrand Reinhold, New York, 1988; and Keller, Ed. "Science and Technology of Photography", VCH, New York, 1993. Materials useful in the preparation of color papers are further illustrated by current commercial practice as, for example, by EDGE™, PORTRA™ or SUPRA™, Color Papers as sold by Eastman Kodak Company, by FUJI™ FA-family Color Papers as sold by Fuji Photo Film, by KONICA™ QA-family Color Papers as sold by Konishiroku Industries, by DURATRANS™ and DURACLEAR™ display films as sold by Eastman Kodak Company and by KONSENSUS-II™ display films as sold by Konishiroku Industries. The advantages of current invention may be achieved by modifying any of these formulations to conform to the requirements set forth in the specification. The exact magnitude of the benefits achieved will, of course, depend on the exact details of the formulations involved but these will be readily apparent to the skilled practitioner.

It is contemplated that the color display material and specifically the color paper according to the present invention will further comprise ultraviolet absorber dyes and soluble dyes removed during processing, all as known in the art. Additionally, the color display material may comprise a substituted pyrazolotriazole or a substituted 3-aminopyrazolone magenta dye-forming image coupler which may be a four equivalent coupler but is preferably a two equivalent coupler. The term "equivalent" indicates the formal stoichiometric relationship between the number of moles of silver reduced per mole of image dye formed in a coupling reaction. The couplers and coupler mixtures described at U.S. Pat. Nos. 5,091,297; 5,270,153; 4,675,280; 4,755,455; 4,954,431; 5,110,718; 5,084,375; 4,600,688; 4,443,536; and 4,830,955 are additionally useful in the practice of this invention.

While photographic elements comprising the dispersions of the invention can be single color elements, preferred elements are multicolor elements. Multicolor elements contain image dye-forming units sensitive to each of the three primary regions of the spectrum desribed above. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Any blue spectral sensitizing dye having a peak spectral sensitivity between 440 and 475 nm may be utilized in the invention. Chemical structures of preferred blue sensitizing dyes useful in the practice of this invention are shown below.

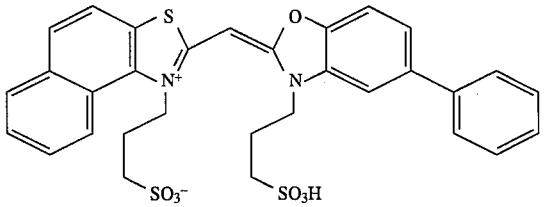

SBD-1

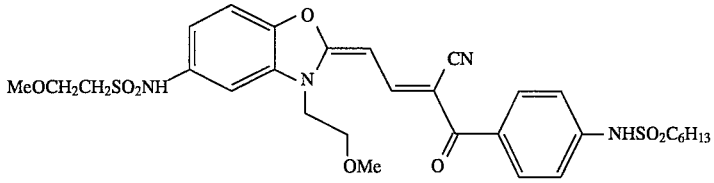

SBD-2

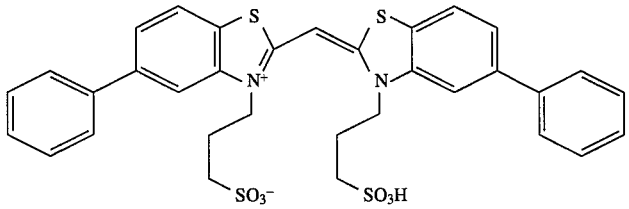

SBD-3

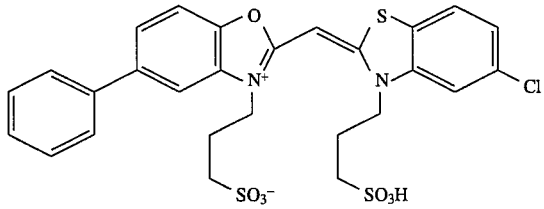

SBD-4

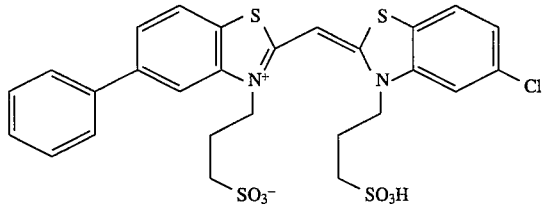

SBD-5

-continued
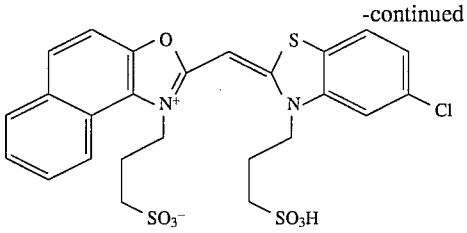
SBD-6
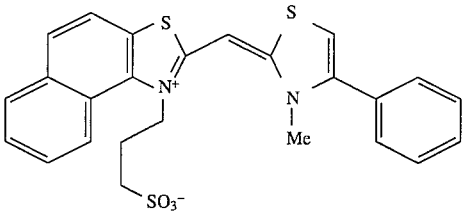
SBD-7
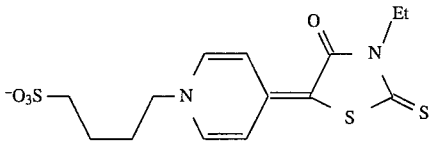
SBD-8
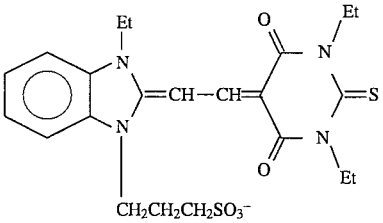
SBD-9
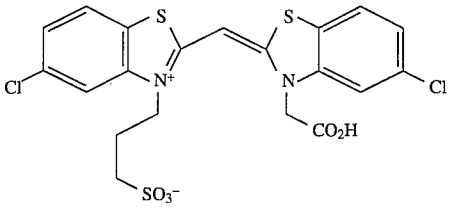
SBD-10
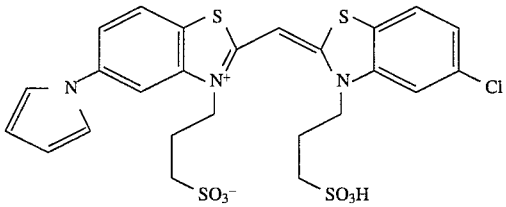
SBD-11
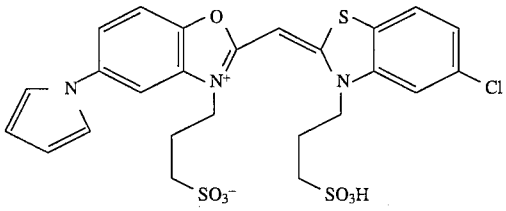
SBD-12
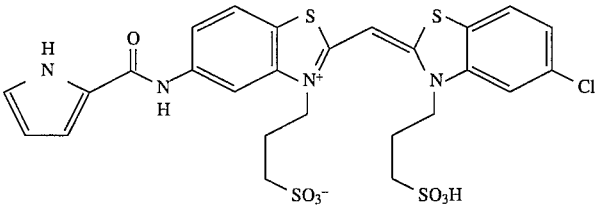
SBD-13

-continued

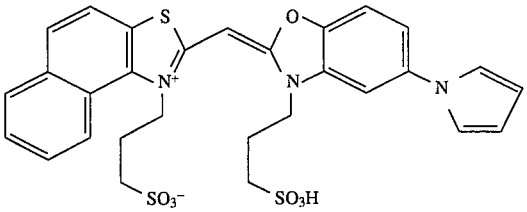

SBD-14

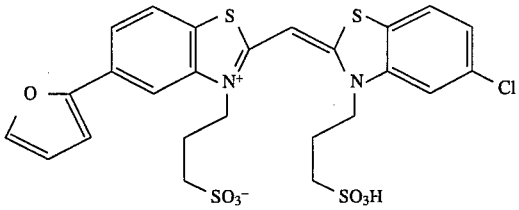

SBD-15

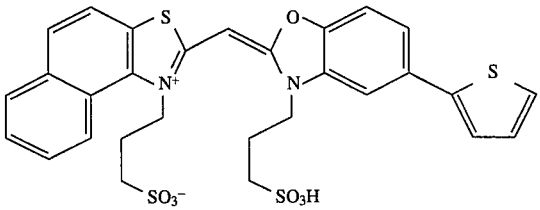

SBD-16

In a preferred embodiment, in order to promote dispersibility of the sensitizing dye, a triethyl-ammonium cation is used to counterbalance the negative charge of these structures.

Also useful are mixtures of sensitizing dyes that can form co-aggregates with a narrow peak spectral sensitivity between 440 and 475 nm. For example, the following mixtures are particularly useful.

| Dye Combination | Dye 1 | Dye 2 | Molar Ratio |
|---|---|---|---|
| DC-1 | SBD-11 | SBD-4 | 1:5 |
| DC-2 | SBD-11 | SBD-12 | 1:1 |

Particularly preferred sensitizing dyes include those which meet the peak sensitivity requirement set forth above and which are described in co-pending, commonly assigned U.S. patent application Ser. No. 08/245,336 of Dobles et al., filed May 18, 1994, entitled "Blue Sensitizing Dyes with Heterocyclic Substituents", the disclosure of which is hereby incorporated by reference.

It is now believed that some of the improved color reproduction of the elements of the invention arises because as the blue sensitivity of the example color photographic image display material is changed to shorter wavelengths, the material records less of the unwanted blue density associated with the red or green color records of the color negative film as being related to blue light exposure of the color negative film. The result is a greater purity in color reproduction.

The degree of separation in the spectral sensitivities of the blue and green light sensitive color records in the color photographic display material is important in achieving the results of the current invention. Typically, e.g., in a color photographic paper, the red light sensitive color record will have a peak sensitivity at about 700 nm, and the green light sensitive color record will have a peak sensitivity at about 550 nm. From this it follows that the blue light sensitive color record of a color paper useful in the practice of the invention will have a peak sensitivity at a wavelength at least about 75 nm different than the green light sensitive color record of the color paper. Even larger separations will be more preferred.

Couplers that may be used in the color photographic display elements of the invention can be defined as being 4-equivalent or 2-equivalent depending on the the number of atoms of $Ag^+$ required to form one molecule of dye. It is generally preferred to use 2-equivalent couplers in color paper elements in the interest of reducing silver levels. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

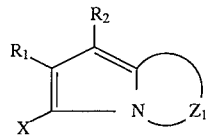

CYAN-2

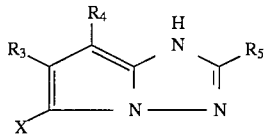

CYAN-3

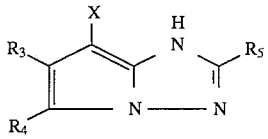

CYAN-4

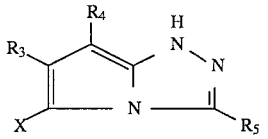

CYAN-5

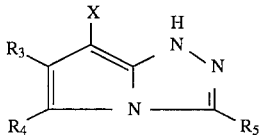

CYAN-6

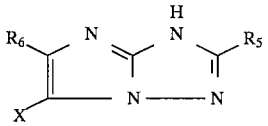

wherein $R_1$ and $R_5$ each represent a hydrogen or a substituent; $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group.

More preferable are cyan couplers of the following formulas:

CYAN-7

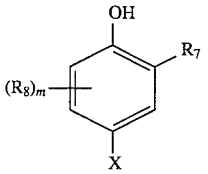

-continued

CYAN-8

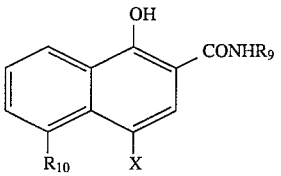

wherein $R_7$ represents a substituent (preferably a carbamoyl, ureido, or carbonamido group); $R_8$ represents a substituent (preferably individually selected from halogen, alkyl, and carbonamido groups); $R_9$ represents ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

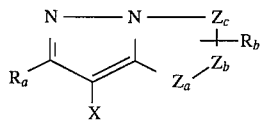

MAGENTA-2

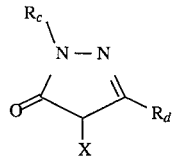

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

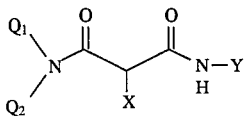

YELLOW-2

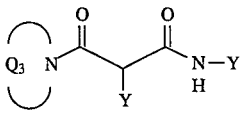

YELLOW-3

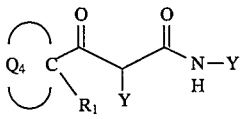

YELLOW-4

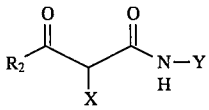

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Typical examples of photographic substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

It may be useful to use a combination of couplers any of which may contain known ballasts or coupling-off groups such as those described in U.S. Pat. Nos. 4,301,235; 4,853,319 and 4,351,897.

Typical couplers that can be used with the elements of this invention include those shown below.

C-1

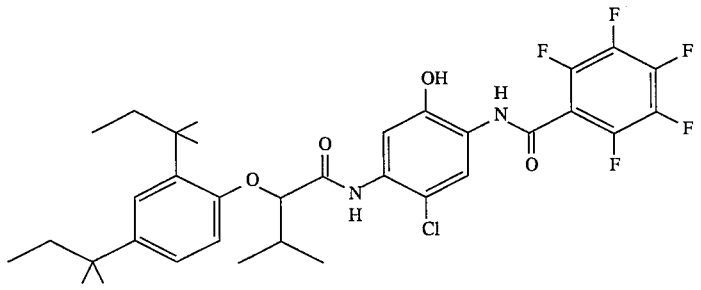

-continued
C-2
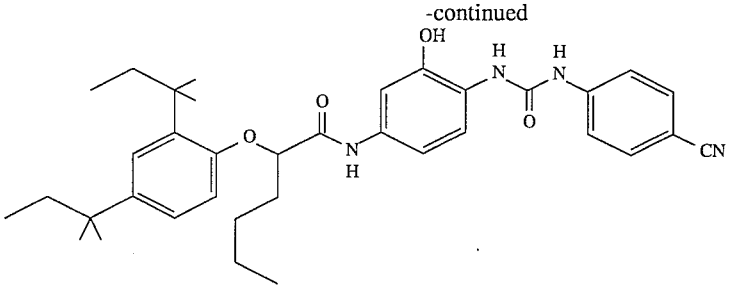
C-3
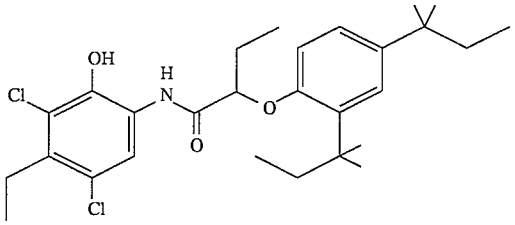
C-4
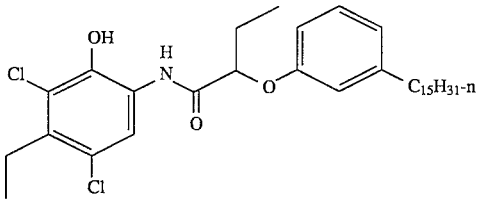
C-5
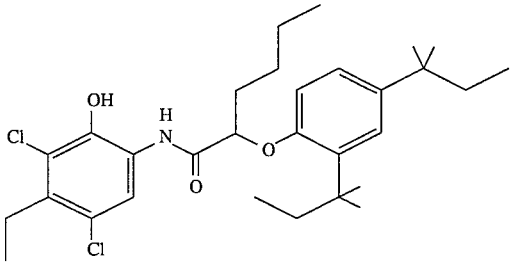
C-6
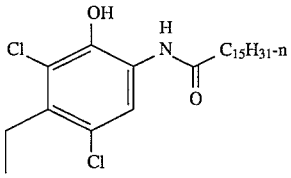
C-7
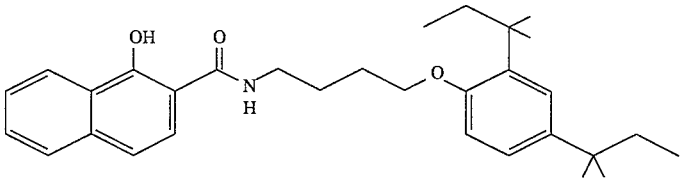
C-8
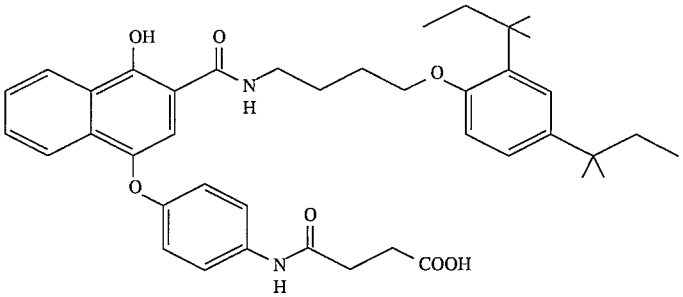

-continued
C-9
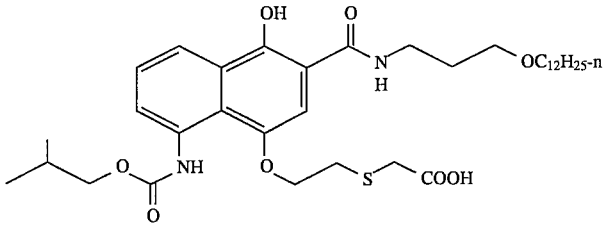
C-10
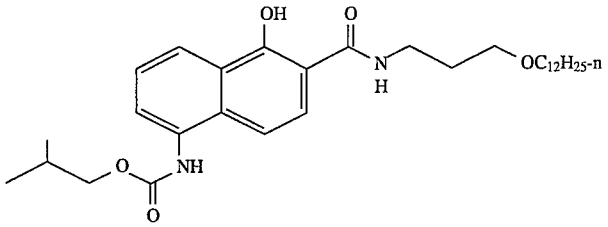
C-11
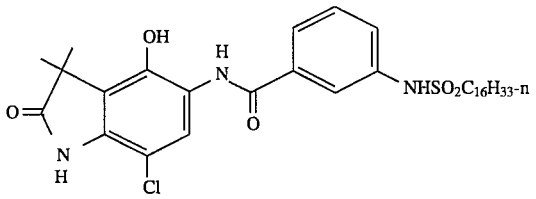
C-12
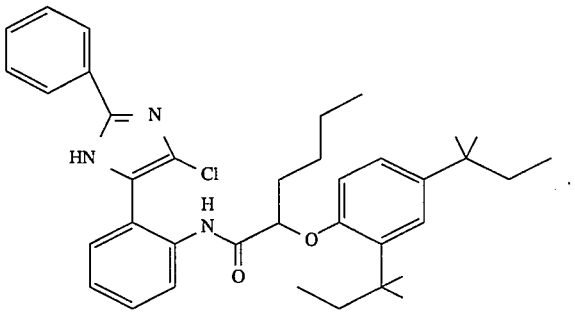
C-13
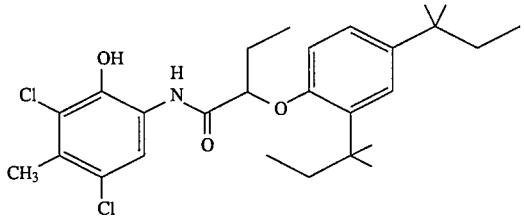
M-1
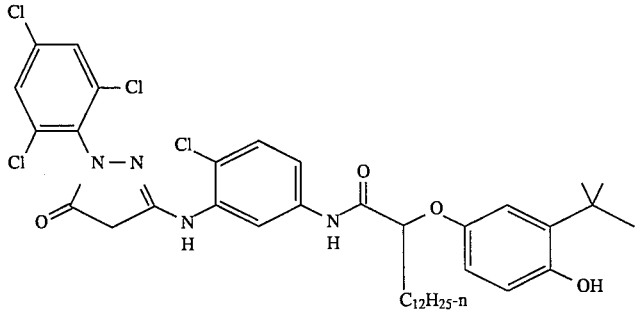

-continued
M-2
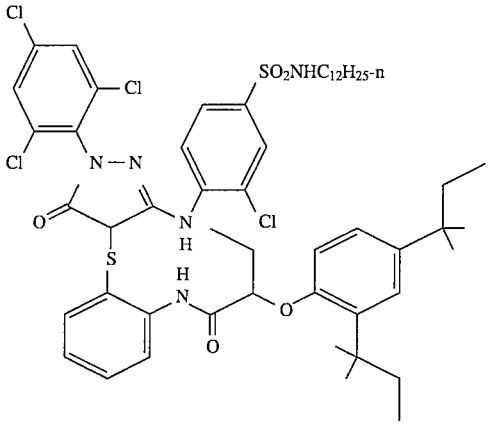
M-3
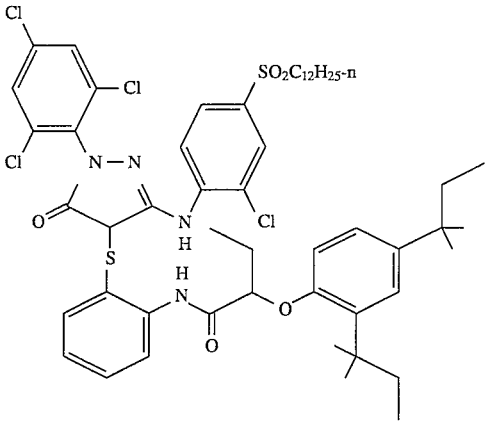
M-4
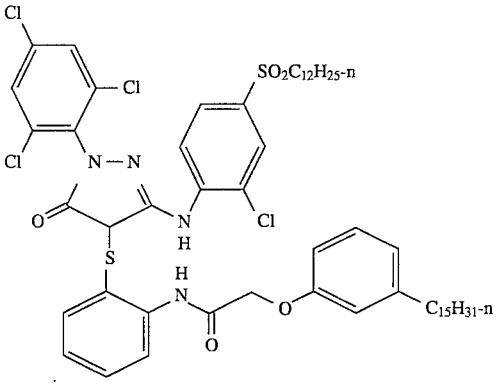
M-5
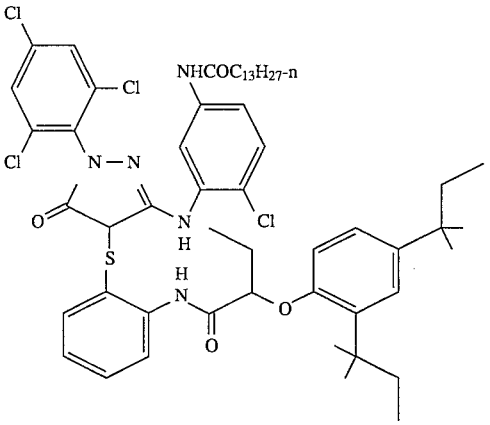

-continued
M-6
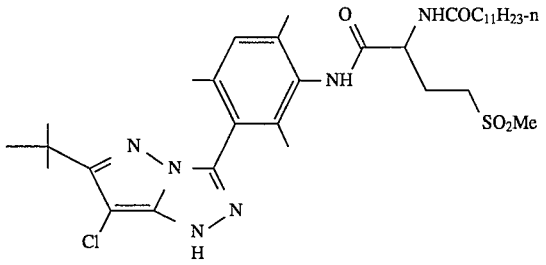
M-7
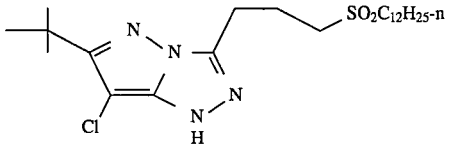
M-8
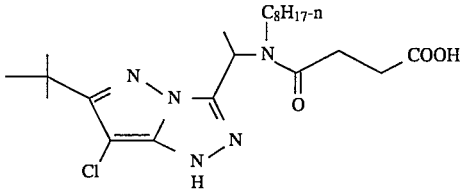
M-9
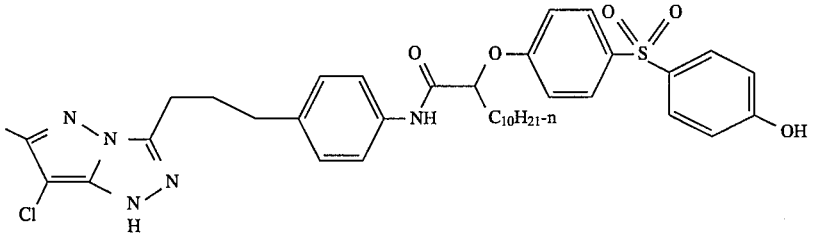
M-10
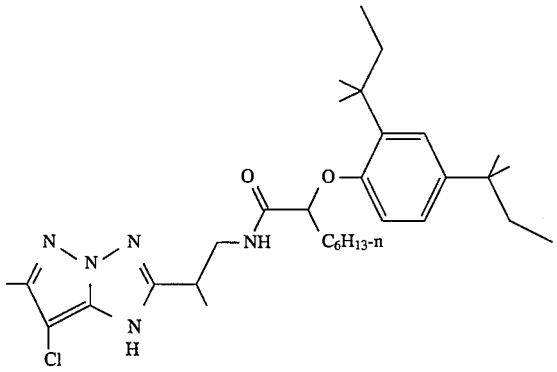
M-11
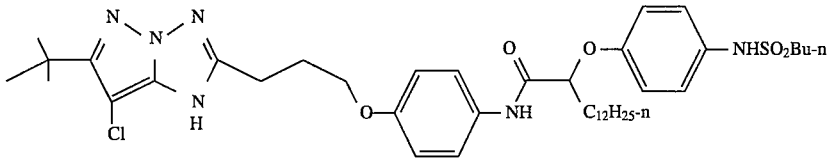
M-12
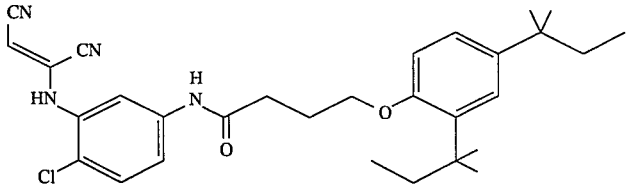

-continued
Y-1
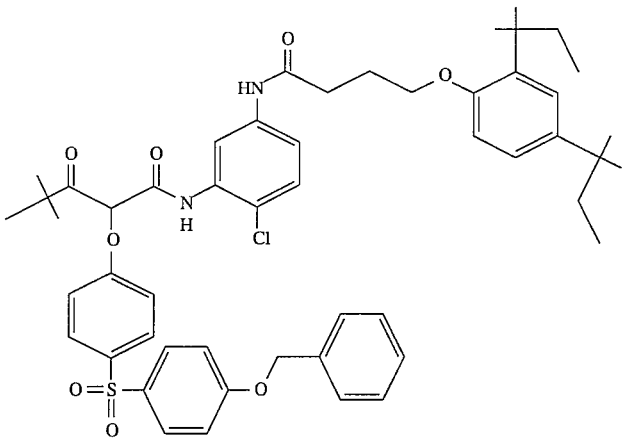
Y-2
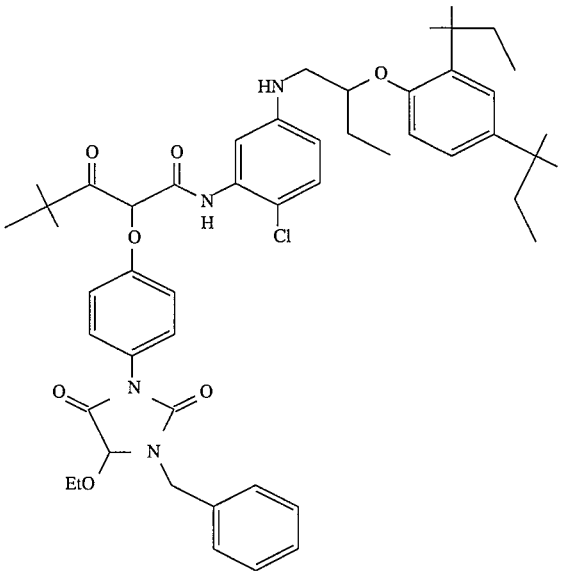
Y-3
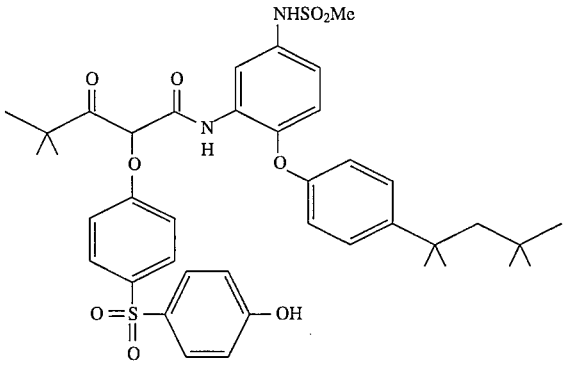

-continued
Y-4
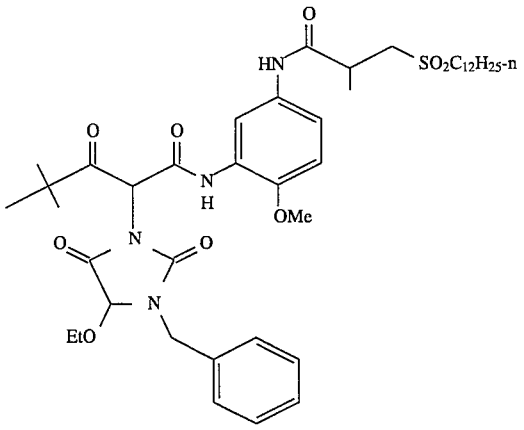
Y-5
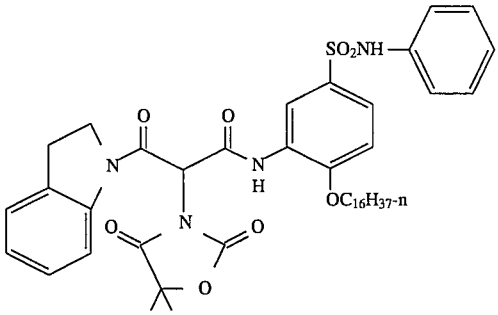
Y-6
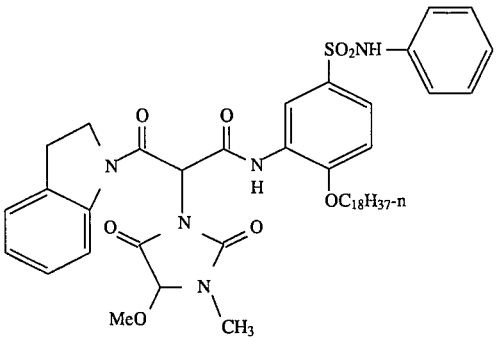
Y-7
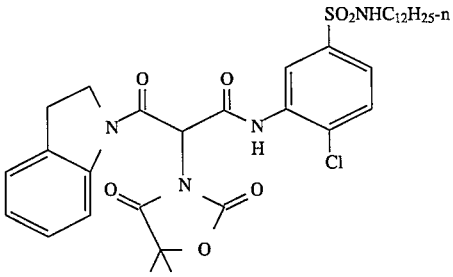
Y-8
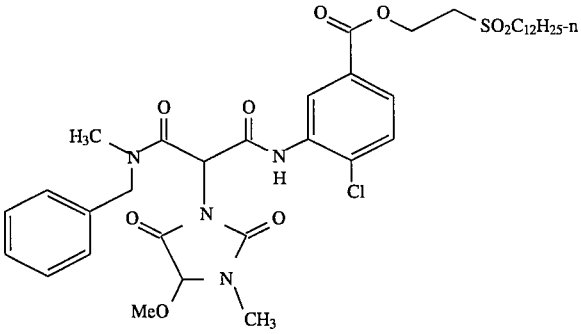

-continued
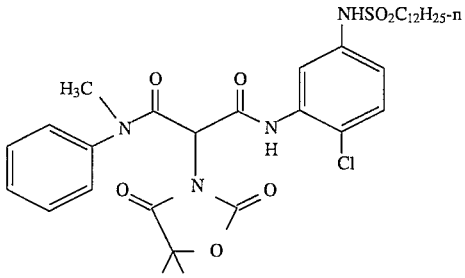
Y-9
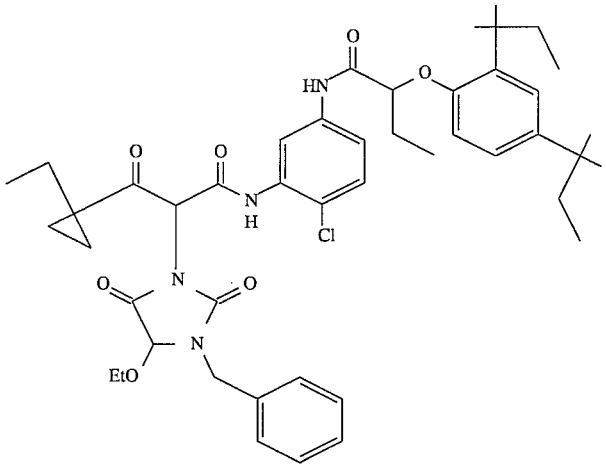
Y-10
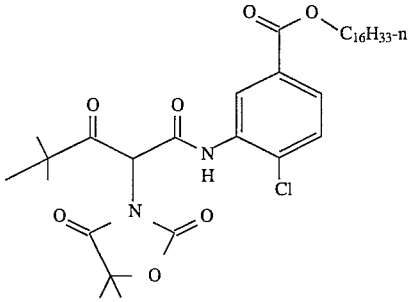
Y-11
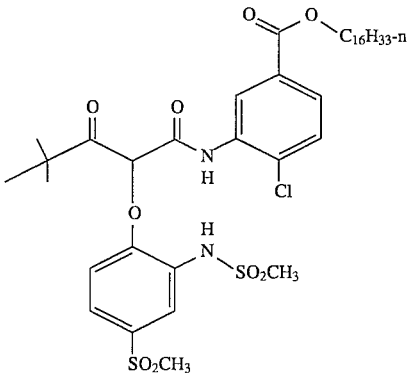
Y-12

-continued
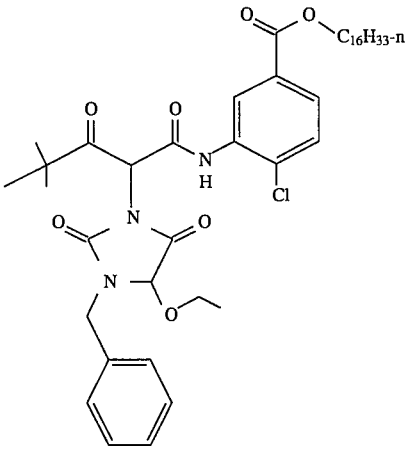
Y-13
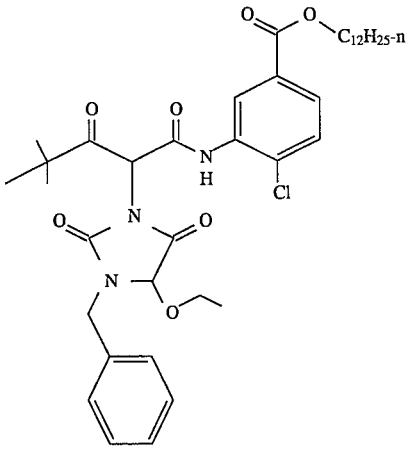
Y-14
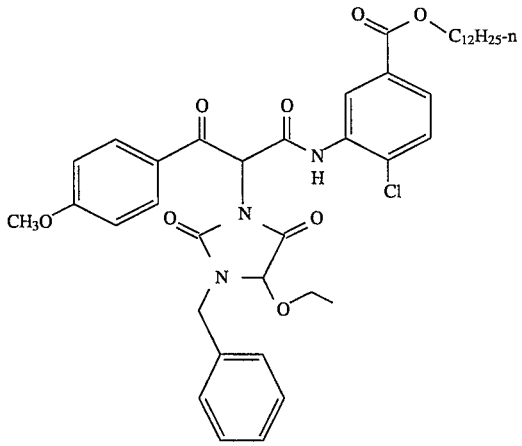
Y-15

-continued

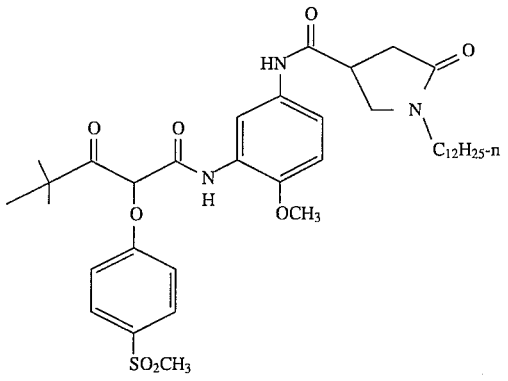

Y-16

Polymer containing dispersions used in the elements of the invention may be prepared by emulsifying a mixed oil solution comprising polymer and the photographically useful compounds desired in the dispersion, such as the yellow dye-forming coupler, as described in U.S. Pat. Nos. 3,619,195 and 4,857,449.

Polymer-containing dispersions of the yellow dye-forming coupler used in the elements of the invention, as well as polymer-containing dispersions of any other desired photographically useful compound, may also be prepared as loaded latex dispersions. These may be prepared according to at least three types of processes. The first process, described in, for example, U.S. Pat. No. 4,203,716, involves dissolving a hydrophobic photographically useful compound to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with. sufficient shear to cause loading as described in concurrently filed, co-pending, commonly assigned U.S. patent application Ser. No. 08/390,400 (Kodak Docket No. 68396AJA), the disclosure of which is hereby incorporated by reference in its entirety. A third possible way to prepare some loaded latex formulations is to simply combine a polymer latex with a dispersed oil solution free of volatile organic solvent, such that the oil solution and latex are miscible, in the presence of surfactant, for a sufficient time before the dispersion is coated for loading to occur as described in concurrently filed, co-pending, commonly assigned U.S. patent application Ser. No. 08/390,722 (Kodak Docket No. 72084AJA), the disclosure of which is hereby incorporated by reference in its entirety.

Polymers used in the invention are preferably water-insoluble, and sufficiently hydrophobic to be incorporated as components of the hydrophobic dispersed phase of the dispersions used in the elements of the invention. The polymers may be prepared by bulk polymerization or solution polymerization processes. Especially preferred among possible polymerization processes is the free-radical polymerization of vinyl monomers in solution.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydrofurfuryl vinyl ether, etc.); vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzene, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy) styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2-aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl)methacrylamide hydrochloride, N-(3-dimethylaminopropyl)methacrylamide hydrochloride, N,N-dipropylacrylamide, N-(1,1-dimethyl-3-oxobutyl)acrylamide, N-(1,1,2-trimethylpropyl)acrylamide, N-(1,1,3,3-tetramethylbutyl)acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl)acrylamide, N-(2-carboxyethyl)acrylamide, 3-acrylamido-3-methylbutanoic acid, methylene bisacrylamide, etc.).

While advantageous results have been achieved using polymers having various compositions and a wide range of glass transition temperatures (e.g., both substantially below and above room temperature), in a preferred embodiment of the invention, the latex polymer comprises at least about 50% N-alkylacrylamide monomer units, where the alkyl substituent preferably has from 3–8 carbon atoms, such as N-tert-butylacrylamide units, which impart particularly desirable photographic performance in the elements of the invention. Polymers of similarly high glass transition temperature (Tg), e.g., higher than 60° C. and more preferably higher than 90° C., are also particularly preferred.

Latex polymers generally comprise polymer particles having an average particle diameter of from about 0.02 to 2.0 microns. In a preferred embodiment of the invention, latex particles having an average diameter of from about 0.03 to 0.5 microns are used in the dispersions of the invention. In a more preferred embodiment, latex particles having an average diameter of from about 0.03 to 0.2 microns are used. The latex polymer average molecular weight generally ranges from about 1000 to 5,000,000. In a preferred embodiment of the invention, loaded latex dispersions of latex particles having an average molecular weight of from about 300,000 to 5,000,000 are formed. In accordance with a further embodiment of the invention, where the latex polymers comprise crosslinked polymers, their molecular weight may far exceed 5,000,000.

Specific examples of useful polymers and polymer latex materials are given below. Copolymer ratios indicated are weight ratios unless otherwise specified.

P-1 Poly(N-tert-butylacrylamide) Tg~146° C.
P-2 Poly (N-cyclohexylamide)
P-3 Poly (N-sec-butylacrylamide)
P-4 Poly (N-(1,1,3,3-tetramethylbutyl)acrylamide)
P-5 Poly (N-(1,1,2-trimethylpropyl)acrylamide)
P-6 Poly(N-(1,1-dimethyl-3-oxobutyl)acrylamide)
P-7 Poly(N-(1-phthalimidomethyl)acrylamide)
P-8 Poly(N,N-di-n-propylacrylamide)
P-9 N-tert-butylacrylamide/2-hydroxyethylmethacrylate copolymer (80/20)
P-10 N-tert-butylacrylamide/methylene bisacrylamide copolymer (98/2)
P-11 N-cyclohexylacrylamide/methylene bisacrylamide copolymer (98/2)
P-12 1,1-dimethyl-3-oxobutyl)acrylamide/methylene bisacrylamide copolymer (98/2)
P-13 Methyl acrylate/2-acrylamido-2-methylpropane sulfonic acid copolymer (96/4)
P-14 Methyl acrylate/2-acrylamido-2-methylpropane sulfonic acid copolymer (98/2)
P-15 Methyl acrylate/2-acrylamido-2-methylpropane sulfonic acid/2-acetoacetoxyethyl methacrylate copolymer (91/5/4) Tg~24° C.
P-16 Methyl acrylate/2-acrylamido-2-methylpropane sulfonic acid/ethylene glycol dimethacrylate copolymer (96/2/2)
P-17 Butyl acrylate/2-acrylamido-2-methylpropane sulfonic acid sodium salt/2-acetoacetoxyethyl methacrylate copolymer (90/6/4) Tg~42° C.
P-18 Butyl acrylate/2-acrylamido-2-methylpropane sulfonic acid/ethylene glycol dimethacrylate copolymer (90/6/4)
P-19 Butyl acrylate/styrene/methacrylamide/2-acrylamido-2-methylpropane sulfonic acid sodium salt copolymer (55/29/11/5)
P-20 Butyl acrylate/styrene/2-acrylamido-2-methylpropane sulfonic acid sodium salt copolymer (85/10/5)
P-21 Poly(butyl acrylate)
P-22 Poly(hexyl acrylate)
P-23 Poly(butyl methacrylate)
P-24 Poly(hexyl methacrylate)
P-25 Poly(vinylidene chloride)
P-26 Poly(vinyl chloride)
P-27 Styrene/vinyl acetate copolymer (1/1 molar)
P-28 Styrene/methyl vinyl ether copolymer (1/1 molar)
P-29 Ethylene/vinyl acetate copolymer (1/1 molar)
P-30 Poly(glycidyl methacrylate)
P-31 Poly(methylmethacrylate) Tg~110° C.
P-32 Glycidyl methacrylate/ethylene glycol dimethacrylate copolymer (95/5)
P-33 Poly(acrylonitrile)
P-34 Acrylonitrile/vinylidene chloride/acrylic acid copolymer (15/79/6)
P-35 Styrene/butyl methacrylate/2-sulfoethyl methacrylate sodium salt copolymer (30/60/10)
P-36 Polystyrene
P-37 Poly(4-acetoxystyrene)
P-38 Poly(4-vinylphenol)
P-39 Poly(4-t-butoxycarbonyloxystyrene)
P-40 2-(2'-Hydroxy-5'-methacrylyloxyethylphenyl)-2H-benzotriazole/ethyl acrylate/2-acrylamido-2-methylpropane sulfonic acid sodium salt copolymer (74/23/3)
P-41 N-tert-butylacrylamide/3-acrylamido-3-methylbutanoic acid copolymer (99.5/0.5)
P-42 N-tert-butylacrylamide/3-acrylamido-3-methylbutanoic acid copolymer (99.0/1.0)
P-43 N-tert-butylacrylamide/3-acrylamido-3-methylbutanoic acid copolymer (98/2)
P-44 N-tert-butylacrylamide/3-acrylamido-3-methylbutanoic acid copolymer (96/4)
P-45 N-tert-butylacrylamide/3-acrylamido-3-methylbutanoic acid copolymer (92/8)
P-46 N-tert-butylacrylamide/methyl acrylate copolymer (25/75)
P-47 N-tert-butylacrylamide/methyl acrylate copolymer (50/50)
P-48 N-tert-butylacrylamide/methyl acrylate copolymer (75/25)
P-49 Poly(methyl acrylate)
P-50 Methyl methacrylate/methyl acrylate copolymer (75/25)
P-51 Methyl methacrylate/methyl acrylate copolymer (50/50)
P-52 Methyl methacrylate/methyl acrylate copolymer (25/75)
P-53 N-tert-butylacrylamide/2-acrylamido-2-methylpropane sulfonic acid sodium salt copolymer (98/2)
P-54 N-tert-butylacrylamide/2-acrylamido- 2-methylpropane sulfonic acid sodium salt copolymer (99/1)
P-55 Methyl methacrylate/2-acrylamido-2-methylpropane sulfonic acid sodium salt copolymer (98/2)

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis(isobutyronitrile), 2,2'-azobis(2-amidinopropane) dihydrochloride, etc.

The polymers may additionally comprise photographically useful groups covalently bonded thereto, such as groups which function as photographic couplers, (including yellow, magenta and cyan image-forming couplers, colored or masking couplers, inhibitor-releasing couplers, and bleach accelerator-releasing couplers, dye-releasing couplers, etc.), UV absorbers, dyes, reducing agents (including oxidized developer scavengers and nuclearors), stabilizers (including image stabilizers, stain-control agents, and developer scavengers), developing agents, optical brighteners, lubricants, etc.

The elements of the invention may generally comprise a wide range of polymer to yellow dye-forming coupler weight ratios in the blue-sensitive layer. Preferred ratios are from about 40:1 to 1:10, more preferred ratios being from about 4:1 to 1:5. The polymers and polymer latexes described above may also be incorporated in other layers of the elements of the invention as desired, for example as loaded latex dispersions of magenta or cyan dye-forming couplers or other photographically useful compounds.

It has been found particularly advantageous to use the invention in combination with pyrazoloazole magenta couplers such as described by the general formula MAGENTA-1. The combination of a magenta coupler of the formula MAGENTA-1, a short blue sensitized high silver chloride emulsion and a dispersion comprising a yellow coupler and a water insoluble polymer surprisingly has been found to give even more preferred color reproduction characteristics.

For the reasons described above, short-blue sensitive emulsions which are used in the elements of the invention may have a lower practical printing speed than emulsions with either broader sensitivity (e.g., silver bromochloride emulsions) or with longer spectral sensitivity. However, several approaches may alleviate this problem, and provide practical blue printing speeds in commercial systems.

A useful method to compare practical speeds of various sensitized print materials would be to find an appropriate exposure time and printer lamphouse filtration such that a representative scene on a color negative film would result in a pleasing print. The changes in either exposure time or filtration necessary to achieve the same result in density and color balance for the various other print materials would be an assessment of the practical printing speed.

A useful filtration package that has been found to simulate the minimum density region of a typical color negative film is described below. A color photographic element is exposured for 0.1 seconds in a Kodak Model 1B sensitometer with a color temperature of 3000 K through a combination of a Kodak Wratten™ 2C plus a Kodak Color Compensating™ filter of 85 cc magenta plus a Kodak Color Compensating™ filter of 130 cc yellow. The exposures are performed by contacting the paper samples with a neutral exposure tablet having an exposure range of 0 to 3 log E. The intensity of light at the exposure plane with no tablet filtration in log Lux is 3.04. Where the speed point is defined as the minimum exposure through a neutral exposure tablet which gives a density of 0.8 on the D log E characteristic curve, in a preferred embodiment of the invention the blue sensitive emulsions of the print materials have a minimum speed such that the speed point is achieved at the exposure through the neutral filter (as described above) which has a density of the tablet of 1.4 or greater, more preferably 1.5 or greater and most preferably 1.6 or greater.

Alternatively, knowledge of the (1) spectral sensitivity of the print material, the (2) spectra of the balanced printer illuminant, and the (3) spectral transmittance of a neutral exposure on the film in question, would allow a quantitative measure of the printing density of the film as seen by the various print materials. Printing density of a film, as described in "The Theory of the Photographic Process", by T. H. James, pp. 520–521, furnishes a specification of the effect of an absorber (the film) in reducing the exposure received by a print material, and therefore is directly correlated to printing speed. Printing density, by definition, is the negative log of the integration of the spectral cascade of the three quantities mentioned above. The absolute printing density of a camera normal exposure (that is, an 18% gray) of a typical 100 ISO speed color negative film is about 1.5 (defined at a log E equal to −1.035).

Despite the deficiency of blue light in tungsten illumination, most printers balanced for typical color negative films on current print materials have some degree of additional magenta and yellow filtration to adjust for preferred color balance. Typically, up to 10 cc yellow filtration can be removed from a majority of printers, in order to accommodate a 0.10 Log E effective blue printer speed loss to be printed at the same exposure time. This 10 cc removal would still allow an adequate amount of yellow filtration for color balance manipulation, whereas removing all yellow filtration would be deemed unacceptable by photofinishers. Thus, in a preferred embodiment, for a camera normal exposure as described above, the blue sensitive emulsion of the invention materials should be no slower than to result in a 0.10 Log E effective blue printer speed loss from a printing density of about 1.5.

Also, despite limited blue printing speed, most color print papers also contain some amount of yellow absorber dye used to adjust blue speed to a specified aim, and provide for manufacturing uniformity. Careful control of emulsion speed variability by other means allows for reduction of absorber dye in the print material, providing additional blue printing speed to offset the lower blue printing speed seen with the short-blue sensitive emulsions.

Further, changes in the blue-sensitive silver chloride emulsion grains themselves can contribute to additional printing speed that allows a practical photographic print paper to have short-blue sensitization. Such changes can include larger grain size, control of the level and placement of bromide and iodide, control of emulsion finish and dopants, and grain morphologies such as tabular or high-aspect silver chloride emulsion grains.

In particular, in a preferred embodiment of the invention, it is advantageous to use emulsions with high sensitivity such as high chloride [100] tabular grain emulsions (e.g., having an aspect ratio of greater than about 2), as is described in U.S. Pat. Nos. 5,314,798, 5,320,938, and 5,356,764; and high chloride [111] tabular grain emulsions, as is described in U.S. Pat. Nos. 5,264,337 and 5,292,632, the disclosures of which are hereby incorporated by reference. Further, ruthenium doped emulsions would also be particularly advantageous (see U.S. Pat. Nos. 4,945,035, 5,252,451, 5,256,530, 5,385,817, and co-pending, commonly assigned U.S. patent application Ser. No. 08/003,181 by MacIntyre and Bell filed Jan. 12, 1993, the disclosures of which are hereby incorporated by reference). In addition, addenda can be added to the emulsion to increase the effective dyed-speed such as described in co-pending, commonly assigned U.S. patent application Ser. No. 08/331,786 by Johansson and Lok filed Oct. 31, 1994, the disclosures of which are hereby incorporated by reference. Useful examples of a color paper structure which incorporates larger grain emulsions is disclosed in concurrently filed, co-pending, commonly assigned U.S. patent application Ser. No. 08/390,448 by Hahm et al (Kodak Docket No. 68167PAL), the disclosures of which are hereby incorporated by reference. Particularly advantageous would be the use of silver chloride emulsions which have up to 1.0% iodide such as described in co-pending, commonly assigned U.S. patent application Ser. No. 08/362,283 by Chen et al entitled "Cubical Silver Iodochloride Emulsions, Processes For Their Preparation And Photographic Print Elements" filed Dec. 22, 1994, the disclosures of which are hereby incorporated by reference.

Finally, changes in the color negative can increase the practical system print speed, including limiting the amount of blue light absorption by the negative by limiting the amount of yellow-colored masking couplers, etc.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The preferred silver halide emulsions employed in the photographic elements of the invention are negative-working. Suitable emulsions and their preparation as well as methods of chemical and spectral sensitization are described in Sections I, and III–IV. Vehicles and vehicle related addenda are described in Section II. Dye image formers are described in Section X. Various additives such as UV dyes, brighteners, luminescent dyes, antifoggants, stabilizers, light absorbing and scattering materials, coating aids, plasticizers, lubricants, antistats and matting agents are described , for example, in Sections VI–IX. Layers and layer arrangements, color negative and color positive features, supports, exposure and processing can be found in Sections XI–XII, XV–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Various types of hardeners are useful in conjunction with elements of the invention. In particular, bis(vinylsulfonyl) methane, bis(vinylsulfonyl) methyl ether, 1,2-bis(vinylsulfonylacetamido) ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822.

The invention may also be used in combination with photographic elements containing filter dye layers comprising colloidal silver sol or yellow, cyan, and/or magenta filter dyes, either as oil-in-water dispersions, latex dispersions or as solid particle dispersions. Additionally, they may be used with elements containing "smearing" couplers (e.g. as described in U.S. Pat. No. 4,366,237; EP 96,570; U.S. Pat. Nos. 4,420,556 and 4,543,323.)

It is specifically contemplated that the concepts of the present invention may be employed to obtain reflection color prints as described in *Research Disclosure*, November 1979, Item 18716, incorporated herein by reference. Materials of the invention may be used in combination with a photographic element coated on pH adjusted support as described in U.S. Pat. No. 4,917,994; with a photographic element coated on support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171.

Especially useful for use with this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred that aim tabular grain projected areas be satisfied with ultrathin ($t<0.06$ micron) tabular grains. Tabular grain thicknesses typically range down to about 0.02 micron. However, still lower tabular grain thicknesses are contemplated.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area. As mentioned above, a particularly useful tabular grain emulsion for use in conjunction with the invention are the silver chloride [100] tabular grain emulsions described in U.S. Pat. No. 5,320,938.

The emulsions can be surface-sensitive emulsions, i.e., emulsions that form latent images primarily on the surfaces of the silver halide grains, or the emulsions can form internal latent images predominantly in the interior of the silver halide grains. Further, the emulsions that can be used in conjunction with elements of the invention are usually negative-working emulsions. Further, it would be advantageous to use the invention in conjunction with emulsions which give a preferred tone scale as described in co-pending, commonly assigned U.S. patent application Ser. No. 08/199,035 of Bell et al., filed Feb. 18, 1994, entitled "Silver Halide Color Photographic Element With Improved high Density Contrast and Bright Low Density Colors".

Due to a desire for rapid development, preferred emulsions for color paper are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum.

Color paper elements typically contain less than 0.80 $g/m^2$ of total silver. Due to the need to decrease the environmental impact of color paper processing, it is desired to decrease the amount of total silver used in the element as much as possible. Therefore, total silver levels of less than 0.65 $g/m^2$ are preferable, and levels of 0.55 $g/m^2$ are even more preferable. It is possible to reduce further the total silver used in the color paper photographic element to less than 0.10 $g/m^2$ by use of a so-called development amplication process whereby the incorporated silver is used only to form the latent image, while another oxidant, such as hydrogen peroxide, serves as the primary oxidant to react with the color developer. Such processes are well-known to the art, and are described in, for example, U.S. Pat. No. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

The red- and green-sensitive emulsions in the elements of the invention can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and EP Patent Application 93/203193.3, in conjunction with elements of the invention.

The invention materials may also be used in association with nucleating agents, development accelerators or their precursors (UK Patent 2,097,140; U.K. Patent 2,131,188); electron transfer agents (U.S. Pat. Nos. 4,859,578 and 4,912,025); antifogging and anticolor-mixing agents such as derivatives of hydroquinones, aminophenols, amines, gallic acid; catechol; ascorbic acid; hydrazides; sulfonamidophenols; and non color-forming couplers.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-delta,delta,delta',delta'-tetramethyl-, dihexyl ester; 1,4-Benzenedipentanoic acid, 2-hydroxy-5-methoxy-delta,delta,delta',delta'-tetramethyl-, dihexyl ester; and 2,5-dimethoxy-delta,delta,delta',delta'-tetramethyl-, dihexyl ester.

Various stabilizers that improve image preservability may be used in conjunction with the elements of this invention. Color prints require excellent image preservability to conditions of heat and humidity, and in many cases excellent light stability is also required. Such stabilizers can include any described in the art, including including epoxides, sulfinates, hydroxylamines, hindered phenols, bisphenols, electron-rich aromatic compounds, and polymers. The polymers used with the yellow coupler according to the invention may also affect the image preservability of the yellow dye image formed.

Various kinds of discoloration inhibitors can be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance, those of hydroquinones are disclosed in U.S. Pat. Nos. 2,360,290; 2,418,613; 2,700,453; 2,701,197; 2,710,801; 2,816,028; 2,728,659; 2,732,300; 2,735,765; 3,982,944 and 4,430,425; and British Patent 1,363,921; and so on; 6-hydroxychromans, 5-hydroxycoumarans, spirochromans are disclosed in U.S. Pat. Nos. 3,432,300; 3,573,050; 3,574,627; 3,698,909 and 3,764,337; and Japanese Published Patent Application 52-152,225; and so on; spiroindanes are disclosed in U.S. Pat. No. 4,360,589; those of p-alkoxyphenols are disclosed in U.S. Pat. No. 2,735,765; British Patent 2,066,975; Japanese Published Patent Applications 59-010,539 and 57-019,765; and so on; hindered phenols are disclosed, for example, in U.S. Pat. Nos. 3,700,455; 4,228,235; Japanese Published Patent Applications 52-072,224 and 52-006,623; and so on; gallic acid derivatives, methylenedioxybenzenes and aminophenols are disclosed in U.S. Patents 3,457,079; 4,332,886; and Japanese Published Patent Application 56-021,144, respectively; hindered amines are disclosed in U.S. Pat. Nos. 3,336,135; 4,268,593; British Patents 1,326,889; 1,354,313 and 1,410,846; Japanese Published Patent Applications 51-001,420; 58-114,036; 59-053,846; 59-078,344; and so on; those of ether or ester derivatives of phenolic hydroxy groups are disclosed in U.S. Pat. Nos. 4,155,765; 4,174,220; 4,254,216; 4,279,990; Japanese Published Patent Applications 54-145,530; 55-006,321; 58-105,147; 59-010,539; 57-037,856; 53-003,263 and so on; and those of metal complexes are disclosed in U.S. Pat. Nos. 4,050,938 and 4,241,155.

Stabilizers that can be used with the invention include but are not limited to the following.

ST-1
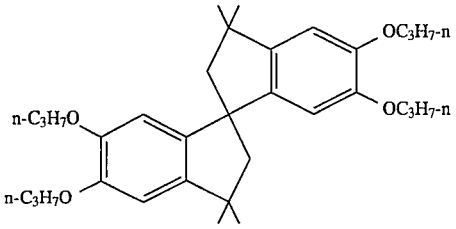
ST-2
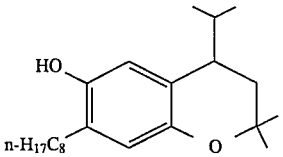
ST-3
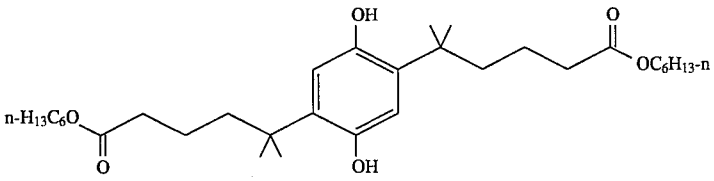
ST-4
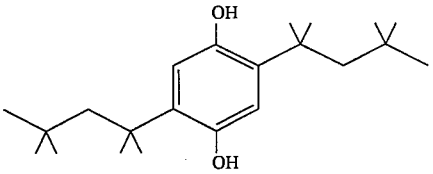
ST-5
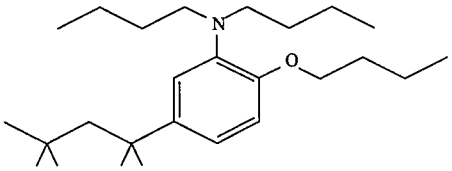
ST-6
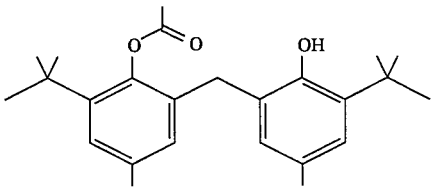
ST-7
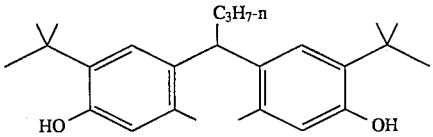
ST-8
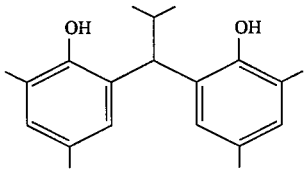
ST-9
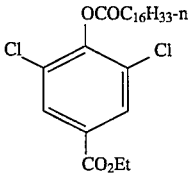

-continued
ST-10
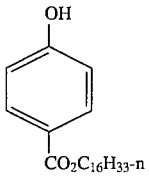
ST-11
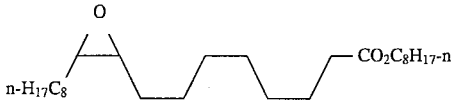
ST-12
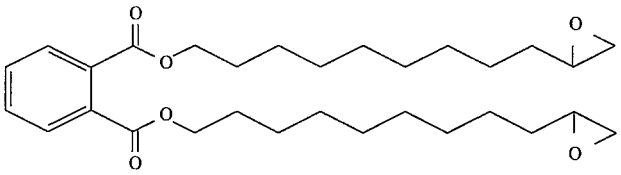
ST-13
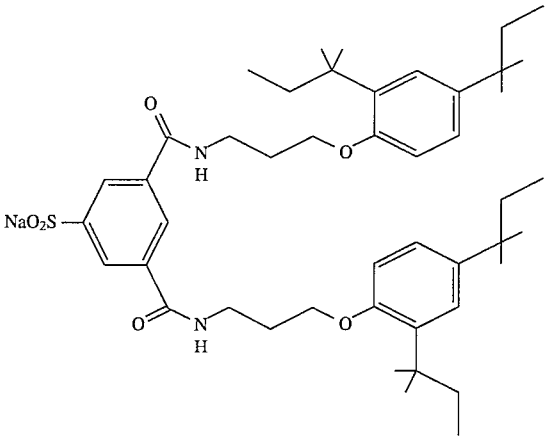
ST-14
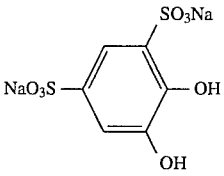
ST-15
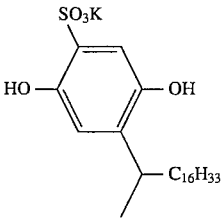
ST-16
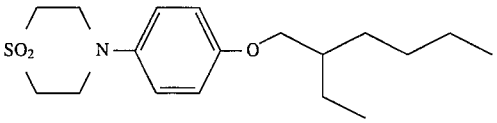
ST-17
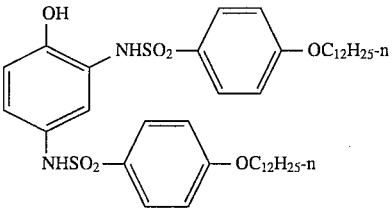

-continued

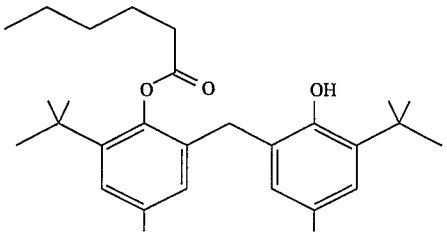

The coupler dispersions in the elements of the invention, as well as dispersions of other photographically useful compounds, may be prepared by means known in the art. The organic, or oil phase, components of such dispersions may include high-boiling organic solvents, known as oil formers, coupler solvents, or permanent solvents. High boiling solvents have a boiling point sufficiently high, generally above 150° C. at atmospheric pressure, such that they are not evaporated under normal dispersion making and photographic layer coating procedures. Non-limitive examples of high boiling organic solvents that may be used include the following.

| | |
|---|---|
| S-1 | Dibutyl phthalate |
| S-2 | Tritolyl phosphate |
| S-3 | N,N-Diethyldodecanamide |
| S-4 | Tris(2-ethylhexyl)phosphate |
| S-5 | Octyl oleate monoepoxide |
| S-6 | 2,5-Di-t-pentylphenol |
| S-7 | Acetyl tributyl citrate |
| S-8 | 1,4-Cyclohexylenedimethylene bis(2-ethylhexanoate) |
| S-9 | Bis(2-ethylhexyl) phthalate |
| S-10 | 2-phenylethyl benzoate |
| S-11 | Dibutyl sebacate |
| S-12 | N,N-Dibutyldodecanamide |
| S-13 | Oleyl alcohol |
| S-14 | 2-(2-Butoxyethoxy)ethyl acetate |

Auxiliary solvents may also be included in dispersion making processes. Many useful auxiliary solvents are water immiscible, volatile solvents, and solvents with limited water solubility which are not completely water miscible. Examples of these include the following.

| | |
|---|---|
| A-1 | Ethyl acetate |
| A-2 | Cyclohexanone |
| A-3 | 4-Methyl-2-pentanol |
| A-4 | Triethyl phosphate |
| A-5 | Methylene chloride |
| A-6 | Tetrahydrofuran |

The photographic elements of the invention are anticipated to include UV stabilizers. The UV stabilizers may be soluble polymers, polymer latexes, and dispersed compounds. In addition, it is contemplated that materials of this invention may be used with so-called liquid ultraviolet absorbers such as described in U.S. Pat. Nos. 4,992,358; 4,975,360; and 4,587,346. Examples of typical dispersed UV stabilizers are shown below.

UV-1

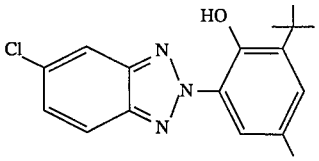

ST-18

-continued

UV-2

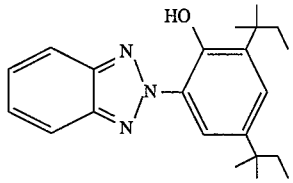

UV-3

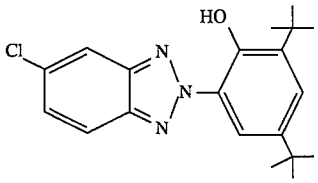

UV-4

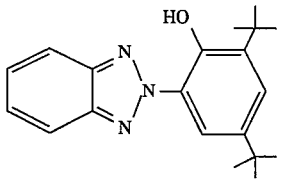

UV-5

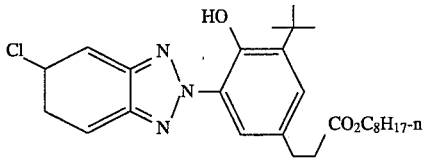

UV-6

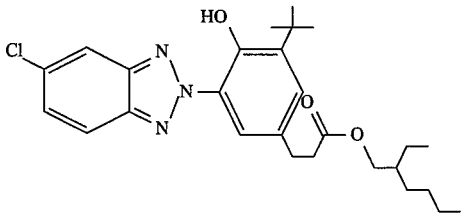

UV-7

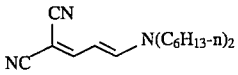

UV-8

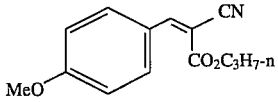

The aqueous phase of the dispersions used in the invention may comprise a hydrophilic colloid, preferably gelatin. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The dispersions and coated layers of the elements of the invention may include surfactants. Surfactants may be cationic, anionic, zwitterionic or non-ionic. Ratios of surfactant to liquid organic solution typically are in the range of 0.5 to 25 wt. % for forming small particle photographic dispersions, which ratios are also useful for forming the invention dispersions. Useful surfactants include, but are not limited the following.

F-1

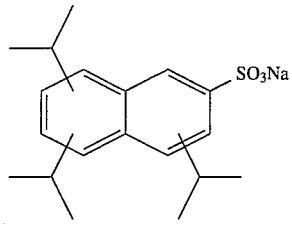

$CF_3(CF_2)_7SO_3Na$ F-2

$CH_3(CH_2)_nSO_3Na$, n = 12–14 F-3

F-4

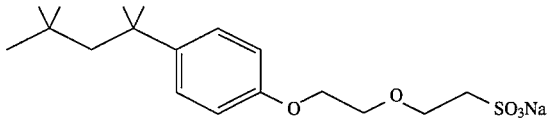

$CH_3(CH_2)_{11}OSO_3Na$ F-5

F-6

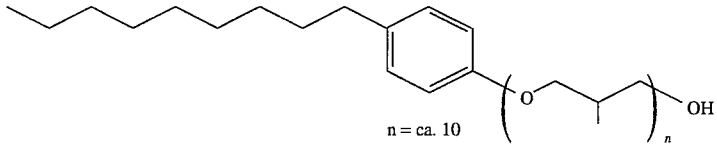

F-7

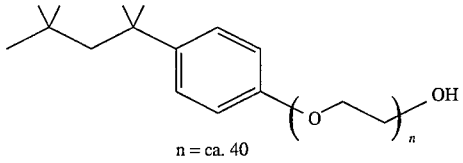

F-8

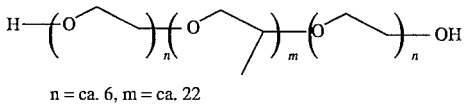

F-9

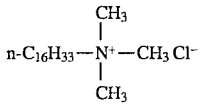

F-10

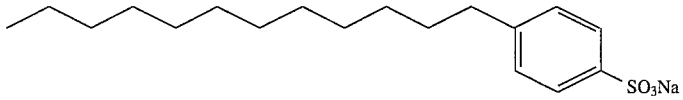

F-11

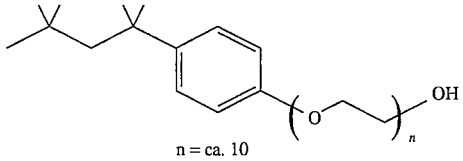

F-12

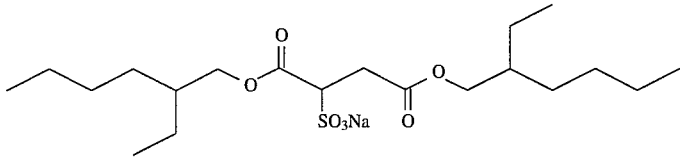

Devices suitable for the high-shear or turbulent mixing of the dispersions of the invention include those generally suitable for preparing submicron photographic emulsified dispersions. These include but are not limited to blade mixers, devices in which a liquid stream is pumped at high pressure through an orifice or interaction chamber, sonication, Gaulin mills, homogenizers, blenders, etc. More than one type of device may be used to prepare the dispersions. For the purposes of this invention, "high shear or turbulent conditions" defines shear and turbulence conditions sufficient to generate a small particle conventional aqueous photographic dispersion of a coupler with a coupler solvent with an average particle size of less than about 0.4 micron.

Photographic color image display materials of the invention can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. It is specifically anticipated that the elements of the invention may be processed in accordance with color print processes, such as the RA-4 process of Eastman Kodak Company as described in the *British Journal of Photography Annual* of 1988, pages 198–199.

In these color photographic systems, the color-forming coupler is incorporated in the light-sensitive photographic emulsion layer so that during development, it is available in the emulsion layer to react with the color developing agent that is oxidized by silver image development.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;

2) color developing→bleaching→fixing→washing/stabilizing;

3) color developing→bleaching→bleach-fixing →washing/stabilizing;

4) color developing→stopping→washing→bleaching→washing→fixing→washing/stabilizing;

5) color developing→bleach-fixing→fixing→washing/stabilizing;

6) color developing→bleaching→bleach-fixing →fixing→washing/stabilizing.

Among the processing steps indicated above, the steps 1) and 2) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, and p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(beta-hydroxyethyl)aniline sulfate, 4-amino-3-methyl-N-ethyl-N-(beta-(methanesulfonamido-ethyl)aniline sesquisulfate hydrate, 4-amino-N,N-diethylaniline hydrochloride, 4-amino-3-methyl-N,N-diethylaniline hydrochloride, 4-amino-3-beta-(methanesulfonamido)ethyl-N,N-diethylaniline hydrochloride and 4-amino-N-ethyl-N-(2-methoxyethyl)-m-toluidine di-p-toluene sulfonic acid.

Of these, particularly preferred is the use of 4-amino-3-methyl-N-ethyl-N-(beta-(methane sulfonamidoethyl)aniline sesquisulfate hydrate, in conjunction with color paper photographic elements of the invention.

Any color originating material and in particular any color negative film exhibiting the characteristics recited below may be employed in conjunction with elements of this invention. Color negative films that may be used in conjunction with this invention typically comprise a support bearing a red light sensitive color record capable of forming a cyan dye deposit, a green light sensitive color record capable of forming a magenta dye deposit and a blue light sensitive color record capable of forming a yellow dye deposit. The dye deposits will typically be formed during a development step which comprises contacting the color negative film with a basic solution and a paraphenylene diamine color developing agent which reduces exposed silver halide to metallic silver and is itself oxidized. The oxidized color developing agent in turn reacts with a photographic coupler to form the chromogenic cyan, magenta and yellow dye images, all as known in the art. The coupler may be introduced into the film during processing but is preferably present in the film before exposure and processing. The coupler may be monomeric or polymeric in nature. The color negative film may then be optionally desilvered using any technique known in the art.

The image thus formed is borne on a support that is sufficiently transparent to enable the subsequent color printing step onto the color image display materials of the invention. The components, assembly and processing of color negative films is described in detail at *Research Disclosure*, Item 17643, 1978; and Item 308119, 1989, the disclosures of which are incorporated by reference. The color negative films may additionally be developed, bleached, and fixed using any of the solutions, components, and sequences described in copending U.S. patent application Ser. No. 08/035,347 by Buchanan et al filed Mar. 22, 1993, the disclosures of which are incorporated by reference. Materials and methods useful in the preparation of color negative films are additionally described at T. H. James, Ed., "The Theory of the Photographic Process," Macmillan, New York, 1977; "The Kirk-Othmer Encyclopedia of Chemical Technology," John Wiley and Sons, New York, 1993; Neblette's "Imaging Processes and Materials," Van Nostrand Reinhold, New York, 1988; and Keller, Ed. "Science and Technology of Photography", VCH, New York, 1993.

Typically color negative films illustrating art recognized practice in the layer order, formulation, manufacture and in the selection and use of components for color negative films include Gold Plus 100™, Gold Ultra 400™, Ektar 25™, Ektar 1000™, Vericolor III™, Eastman High Speed Motion Picture Film™ all manufactured and sold by Eastman Kodak Company, SH-100™, SH-400™ and SH-800™ color negative films all manufactured and sold by Fuji Photo Film. The advantages of current invention may be achieved by printing any of these films on a color negative print paper of the invention. The exact magnitude of the benefits achieved will, of course, depend on the exact details of the formulations involved but these will be readily apparent to the skilled practitioner.

Color negative films which can be used in conjunction with the current invention may additionally incorporate integral color masking couplers, including yellow masking couplers as described originally by Hanson and Vittum in the *Photographic Society of America Journal*, Vol. 13, 94-ff (1947) and as disclosed in the previously cited general references. The term yellow masking coupler means any compound that enables a reduction in blue density attributable to a dyestuff associated with that compound in a photographic layer as a function of increased exposure level and increased development of that photographic layer. The yellow masking couplers useful in the practice of this invention include any of the yellow masking couplers known in the art. Specifically contemplated are those described in the general descriptions of color originating films disclosed above and those employed commercially as, for example, in the specific color negative films mentioned earlier. The term coupler generally means a compound capable of reacting in a basic environment with the oxidized form of a paraphenylene diamine color developing agent to form a chromogenic dye. The coupler can form any chromogenic dye and specifically a chromogenic cyan dye, a chromogenic magenta dye, a chromogenic yellow dye or even a chromogenic black dye. The dye formed can remain in the film structure to provide density or can be any of the known structures that either decolorize as a result of chemical interaction or are sufficiently solubilized so as to be removed from the film structure during processing. For the purposes of this specification, the term yellow masking coupler additionally includes compounds that can release, form or liberate the yellow mask or dyestuff by a cross oxidation process with oxidized color developer or by direct interaction with reducible silver halide, including substituted hydrazide release compounds, substituted hydroquinone release compounds and such, all as known in the art. The yellow masking coupler can be yellow before processing or it can be of another color that changes to yellow only after processing, such as a metal coordination compound or a blocked latent-yellow dye. The yellow mask or dye-stuff liberated during photographic processing can be solubilized and removed from the color originating material during processing or can remain in the color negative material and lessen in blue density only after liberation. Also contemplated are those known compounds that are latent-yellow before processing and form blue density in an anti-imagewise fashion during processing. Specifically contemplated are magenta dye-forming image couplers which release a yellow dye in an imagewise fashion while forming a magenta image dye may be employed in a green light sensitive layer of a color negative film to effectively reduce the imagewise formation of unwanted blue density in that layer while simultaneously providing a high but uniform blue density. Similarly, cyan dye-forming, yellow dye releasing masking couplers and so-called colorless or fugitive dye forming yellow dye releasing couplers are also known and specifically contemplated.

While these masking couplers can improve system color reproduction by lowering the degree of undesired imagewise density formation in the color negative film, they inherently increase the blue density of a Dmin region of the color negative film. The result is that color reproduction can be improved but at a further cost in the useful blue exposure available to, for example, a color paper element of the invention. Reduction of the quantity of color masking coupler when printing onto a color display material of the current invention leads to improvements in printing speed.

For this reason, use of limited quantities of yellow masking coupler in the color negative film are especially desired in the practice of this invention. Since various masking couplers provide differing amounts of blue density and simultaneously reduce blue light transmission through such a color negative film, all as governed by the exact chemical structure of the masking coupler, it is most convenient to define the limiting quantities of masking coupler by the reduction of blue light transmission attributable to these masking couplers at a Dmin region of the color negative film. A reduction in blue light transmission of less than about 75 percent due to the presence of masking couplers is useful in the practice of this invention, a reduction in blue light transmission by less than about 70 percent is preferred and a reduction in blue light transmission less than about 65 percent due to the presence of masking couplers is most preferred. Although color negative films totally lacking in masking coupler are believed to provide adequate color reproduction when used according to the current invention, a minimum 15 percent reduction in blue light transmission due to the presence of masking couplers represents a preferred position. The color negative film should additionally have a Dmin Status M blue density of less than about 1.1 and preferrably a Dmin blue density of less than about 1.0 or most preferrably a Dmin blue density of less than about 0.9.

Color negative films that can be used in conjunction with color image display materials of the invention will typically additionally include development inhibitor releasing compounds, development accelerator releasing compounds, image dye-forming couplers, scavengers, pre-formed dyes and such all as know in the art and as exemplified in the art practice and references cited above and below.

Magenta dye-forming couplers which may be employed in the light sensitive color negative films used in combination with photographic print elements of the invention include optionally substituted 3-amidopyrazoles, pyrazolotriazoles (e.g., couplers M-6 through M-11, and the pyrazolotriazole couplers disclosed in U.S. Pat. No. 5,254,446, incorporated by reference), and 3-aminopyrazoles (e.g., coupler M-5).

Image dyes formed from 3-amidopyrazoles magenta dye-forming image couplers are art recognized to show higher blue density than do those formed from pyrazolotriazoles or 3-aminopyrazoles image couplers. For this reason 3-amidopyrazoles magenta dye-forming image couplers generally required higher degrees of yellow density masking in order to provide desired color reproduction properties. Higher levels of yellow density masking generally result in inferior blue layer granularity in a color negative material. The lambda max and bandwidths associated with dyes formed from these coupler classes is such that less yellow masking may be employed for pyrazolotriazoles or 3-aminopyrazoles image couplers. Mixtures of these couplers may be employed as known in the art to provide additional benefits such as improved dye hue, improved stability, improved physical properties, and improved image to fog discrimination.

Cyan dye-forming couplers which may be employed in the light sensitive color negative films used in combination with photographic print elements of the invention include optionally substituted phenols (e.g., coupler C-2), 2-substituted-1-naphthols (e.g., coupler C-7), and 2,5-disubstituted-1-naphthols and 2-(disubstituted carboxyanilide)-1-naphthols.

Again, cyan dye forming image couplers, like the magenta dye forming coupler previously described, are art recognized to exhibit different degrees of unwanted yellow density on coupling and to thus be best matched with differing degrees of yellow masking for optimal performance. Mixtures of these couplers may be employed as known in the art to provide additional benefits such as improved dye hue, improved stability, improved physical properties, and improved image to fog discrimination.

Yellow dye forming couplers which may be employed in the blue light sensitive layer of color negative films to be used in conjunction with color print elements of the invention include the same yellow dye-forming couplers cited earlier for use in the color print material. Preferred types of yellow couplers include pivaloylacetanilide couplers (e.g., couplers Y-11, Y-13 and Y-14), benzoylacetanilide couplers (e.g., Y-15), acylacetanilide couplers with an 3- to 5-membered ring alpha to the acyl group (e.g., coupler Y-10), and heteroylacetanilide couplers (e.g., couplers Y-6 through Y-9). Particularly preferred are the use of pivaloylacetanilide and benzoylacetanilide yellow couplers.

While any suitable support may be employed for the color originating materials, and specifically the color negative films useful in the practice of the invention, it is specifically contemplated to employ supports bearing magnetic information layers as described in *Research Disclosure*, Item 34390, 1992 and at U.S. Pat. Nos. 5,252,441 and 5,254,449, the disclosures of which are incorporated by reference.

Color negative films employing such layers can be employed in combination with cameras that can record and cause to be stored on such a layer various useful information related to the use and history of the color negative film. Specific examples include but are not limited to exposure information on a per scene and per roll basis. These films can then be processed in automated processing apparatus that can retrieve film characteristic information as well as film exposure and use information, and optionally modify the processing to ensure optimal performance and optionally record the details of processing on the magnetic layer. The films can then be printed using automated printers that can retrieve both film and process history information and optionally alter, based on the information retrieved from the magnetic layer, exposure characteristics chosen from printing time, printing light intensity, printing light color balance, printing light color temperature, printing magnification or printing lens adjustment exposure or printing time and the color filters so as to enable production of well balanced display prints from various color originating materials. These layers can be located on the same side of the support as light sensitive layers or arranged so that the support is between the magnetic layer and the light sensitive layers. This information is useful in altering film processing and printing conditions so as to aid in producing a pleasing image. These magnetic layers tend to absorb light in the blue region of the spectrum thereby further compromising the printing speed that can be attained from such a negative and limiting the amount of blue masking that can be employed, or requiring a faster blue-sensitive emulsion in the color print material.

Automated color printers may be provided with a means to monitor the color density of a color negative material in the blue wavelength range typically centered at about 450 nm and independently in the green range and red range. Means are further provided to alter, based on these density readings, exposure characteristics chosen from printing time, printing light intensity, printing light color balance, printing light color temperature, printing magnification or printing lens adjustment exposure or printing time and the color filters so as to enable production of well balanced display prints from various color originating materials having dyes that differ in hue.

These ranges are appropriate for monitoring the yellow, magenta and cyan dye amounts in the color negative but results in a situation where the color display material, typically sensitized to about 480 nm or more in the blue sensitive layer in accordance with prior art practice, and the color printer monitor read different blue densities from the same scene as recorded in, for example, a color negative. Since the difference in density depends greatly on exactly which image coupler derived dyes are present in the color negative, different correction factors need to be programmed into the automated printer to adequately print a variety of negatives onto a common paper. The resultant need for careful attention and color negative film segregation among automated printers results in a large number of mistakes in the printing process and much rework. It would be much preferred to employ color print materials and automated color printer monitors that were matched in spectral sensitivities. Color display elements according to the present invention provide a solution to this latter problem.

It is additionally contemplated to employ the color negative films useful in the current invention in limited use or single use cameras. Useful characteristics for color negative films and single use cameras are described in co-pending, commonly assigned U.S. patent application Ser. No. 08/135,700 by Sowinski et al entitled "Limited Use Cameras and Films" filed Oct. 13, 1993, the disclosures of which are incorporated by reference.

PHOTOGRAPHIC EXAMPLES:

Example 1

Comparative emulsion AG-1 was prepared in the following manner. A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.74 μm in edgelength size. This emulsion was optimally sensitized by the addition of a colloidal suspension of aurous sulfide and heat ramped up to 60 ° C. during which time blue sensitizing dye BSD-1, 1-(3-acetamidophenyl)-5-mercaptotetrazole and potassium bromide were added.

BSD-1

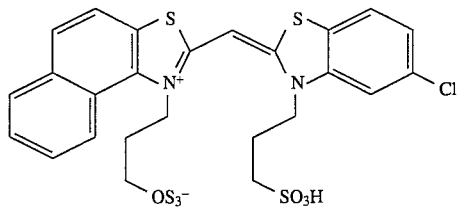

In a similar manner, emulsion AG-2 with short blue sensitization was prepared, using SBD-11 in place of BSD-1. Emulsion AG-3 was similarly prepared, using SBD-1.

Synthesis Example A

Preparation of latex polymer P-1a:

N-t-Butylacrylamide (100 g, Chemie Linz) was slurried with vigorous mixing in a solution of water (234 g) and surfactant F-3 (12.5 g of a 40% aqueous solution). This slurry was added in three portions at 7 minute intervals to an 80° C. stirred 1 L Morton flask equipped with a condenser, under $N_2$ atmosphere, charged with water (150 g), surfactant F-3 (4.2 g of a 40% aqueous solution), and initiator (azobis(cyanovaleric acid) 75%, 1.0 g, Aldrich). The resulting translucent latex was stirred at 80° C. for an additional 3 h. The latex was cooled and filtered, yielding 494 g latex at 21.0% solids. Photon correlation spectroscopy showed an average particle size of 0.057 microns. A sample of the latex was freeze-dried.

$^1$H NMR (300 MHz, $CDCl_3$), δ=1.15 (s, 9H), 1.2–2.2 (m, 3H), 5.6–6.5 (s, broad, 1H). Differential scanning calorimetry showed a $T_g$ of 146° C. Size exclusion chromatography (0.01M $LiNO_3$/N,N-dimethylformamide) showed $M_w$=319,000, $M_n$=65,300. Inherent viscosity, (0.25%, ethyl acetate)=0.63.

Synthesis Example B

Preparation of latex polymer P-1b:

N-t-Butylacrylamide (300 g), 2-propanol (300 mL) and toluene (1500 mL) were combined under a nitrogen atmosphere in a 3 L flack equipped with condenser, stirrer, and thermometer, and the flask was warmed to 80° C. with stirring. Azobis(isobutyronitrile) (3.0 g) was added, and the temperature maintained between 80° C. and 90° C. for 3 hours. With a sweep of nitrogen gas, about 250 mL of solvent was removed from the reactor by evaporation. The polymer was precipitated by adding the reaction mixture slowly to a well-stirred vessel containing 6 L of ligroin. The precipitate was isolated by filtration and dried in a vacuum chamber, yielding 278 g of polymer P-1 as a white powder. Size exclusion chromatography (0.01 M $LiNO_3$/N,N-dimethylformamide) showed $M_w$=32,400, $M_n$=12,700.

A coarse dispersion containing coupler Y-3 was prepared by combining coupler Y-3 (45.0 g) with dibutyl phthalate (S-i) (25.2 g), and heating to 141° C., yielding an oil solution. This was combined with 329.8 g of a 70° C. solution containing 39.0 g gelatin, and 3.6 g surfactant F-1, and the mixture was mixed briefly with a blade mixer to yield a coarse dispersion (particle size >>1 micron).

Comparative dispersion A was prepared by combining 32.0 g of this coarse dispersion at 70° C. with 28.0 g water, and the mixture was recycled at 70° C. for three turnovers at 68 MPa with a Microfluidizer model 110 homogenizer to prepare a fine-particle dispersion.

Dispersion B was prepared in the same manner as dispersion A, combining 32.0 g of the coarse dispersion of coupler Y-3 with 28.0 g of latex polymer P-1a, at a concentration such that the ratio of coupler Y-3 to polymer P-1 in the dispersion was 1.0 : 1.0. The mixture was recycled at 70 ° C. for three turnovers at 68 MPa with a Microfluidizer model 110 homogenizer to prepare a fine-particle loaded-latex dispersion.

Dispersion C was prepared in the same manner as dispersion B, using 28.0 g of latex polymer P-15, at a sufficient concentration such that the ratio of coupler Y-3 to polymer P-15 in the dispersion was 1.0:1.5. The mixture was recycled at 70° C. for three turnovers at 68 MPa with a Microfluidizer model 110 homogenizer to prepare a fine-particle loaded-latex dispersion.

Dispersion D, with the same nominal composition of dispersion B, was prepared by combining coupler Y-3 (3.6 g), solvent S-1 (2.02 g), polymer P1-b (3.6 g), and ethyl acetate (10.78 g). The mixture was stirred with warming to give a clear solution. This was combined with 45 g of an aqueous solution, at 45° C., containing 3.12 g gelatin and 0.288 g surfactant F-1. The combined mixture was stirred briefly at 45° C. to give a coarse dispersion, and was then recycled at 45° C. for three turnovers at 68 MPa with a Microfluidizer model 110 homogenizer to prepare a fine-particle polymer-containing dispersion. The dispersion was stirred in an uncovered container at 45° C. for 2 hours to evaporate the ethyl acetate, and water was added to the original weight before evaporation.

Comparative dispersion E was prepared by combining coupler Y-2 (4.33 g), solvent S-1 (2.43 g), and ethyl acetate (13.24 g). The mixture was stirred with warming to give a clear solution. This was combined with 45 g of an aqueous solution, at 45° C., containing 4.53 g gelatin and 0.34 g surfactant F-1. The combined mixture was homogenized and evaporated as for dispersion D, yielding a fine-particle photographic dispersion.

Dispersion F was prepared in the same manner as dispersion E, adding 1.74 g of polymer P1-b to the oil solution, and reducing the amount of ethyl acetate to 11.50 g. A fine-particle polymer-containing dispersion was obtained after homogenization and evaporation.

Comparative dispersion G was prepared by combining coupler Y-1 (5.67 g), solvent S-1 (3.18 g), and ethyl acetate (11.15 g). The mixture was stirred with warming to give a clear solution. This was combined with 45 g of an aqueous solution, at 45° C., containing 4.53 g gelatin and 0.34 g surfactant F-1. The combined mixture was homogenized and evaporated as for dispersion D, yielding a fine-particle photographic dispersion.

Dispersion H was prepared in the same manner as dispersion G, adding 1.13 g of polymer P1-b to the oil solution, and reducing the amount of ethyl acetate to 10.02 g. A fine-particle polymer-containing dispersion was obtained after homogenization and evaporation.

Coating sample 101, a comparative blue-sensitive photographic element containing dispersion A in the emulsion layer was prepared by coating the following layers.

| LAYER | COMPONENT | AMOUNT |
|---|---|---|
| 2 | F-1 | 0.054 g/m$^2$ |
| | F-2 | 0.004 g/m$^2$ |
| | Gelatin | 1.076 g/m$^2$ |
| 1 | AG-1 Blue sensitive Ag | 0.247 g Ag/m$^2$ |
| | Y-3 from dispersion A | 0.538 g/m$^2$ |
| | S-1 from dispersion A | 0.301 g/m$^2$ |
| | ST-15 | 0.009 g/m$^2$ |
| | F-1 | 0.054 g/m$^2$ |
| | Gelatin | 1.539 g/m$^2$ |
| Support | Polyethylene laminated paper with $TiO_2$/ZnO in the polyethylene laminated in the first layer side, precoated with 3.23 g/m$^2$ gelatin. | |

In the final layer bis(vinylsulfonylmethyl) ether (0.105 g/m$^2$) was added as hardener.

In a similar manner, coatings 102 through 108 were prepared, using dispersions B through dispersion H in place of dispersion A, all with 0.247 g/m$^2$ of comparative emulsion AG-1 as shown in the table below. Coatings 201–208 were prepared in a similar manner to 101–108, using short-blue sensitive emulsion AG-2, and coatings 301–308 were prepared in a similar manner to 101–108, using short-blue sensitive emulsion AG-3.

| Sample | Coupler, g/m$^2$ | Solvent S-1 g/m$^2$ | Polymer/ Polymer:Coupler Ratio | Emulsion | Comment |
|---|---|---|---|---|---|
| 101 | Y-3, 0.538 | 0.301 | none | AG-1 | Comparison |
| 102 | Y-3, 0.538 | 0.301 | P-1a/1.0 | AG-1 | Comparison |
| 103 | Y-3, 0.538 | 0.301 | P-15/1.5 | AG-1 | Comparison |
| 104 | Y-3, 0.538 | 0.301 | P-1b/1.0 | AG-1 | Comparison |
| 105 | Y-2, 0.700 | 0.392 | none | AG-1 | Comparison |
| 106 | Y-2, 0.700 | 0.392 | P-1b/0.4 | AG-1 | Comparison |
| 107 | Y-1, 0.915 | 0.512 | none | AG-1 | Comparison |
| 108 | Y-1, 0.915 | 0.512 | P-1b/0.2 | AG-1 | Comparison |
| 201 | Y-3, 0.538 | 0.301 | none | AG-2 | Comparison |
| 202 | Y-3, 0.538 | 0.301 | P-1a/1.0 | AG-2 | Invention |
| 203 | Y-3, 0.538 | 0.301 | P-15/1.5 | AG-2 | Invention |
| 204 | Y-3, 0.538 | 0.301 | P-1b/1.0 | AG-2 | Invention |
| 205 | Y-2, 0.700 | 0.392 | none | AG-2 | Comparison |
| 206 | Y-2, 0.700 | 0.392 | P-1b/0.4 | AG-2 | Invention |
| 207 | | 0.512 | none | AG-2 | Comparison |
| 208 | Y-1, 0.915 | 0.512 | P-1b/0.2 | AG-2 | Invention |
| 301 | Y-3, | 0.301 | none | AG-3 | Com- |

-continued

| Sample | Coupler, g/m² | Solvent S-1 g/m² | Polymer/ Polymer:Coupler Ratio | Emulsion | Comment |
|---|---|---|---|---|---|
| | 0.538 | | | | parison |
| 302 | Y-3, 0.538 | 0.301 | P-1a/1.0 | AG-3 | Invention |
| 303 | Y-3, 0.538 | 0.301 | P-15/1.5 | AG-3 | Invention |
| 304 | Y-3, 0.538 | 0.301 | P-1b/1.0 | AG-3 | Invention |
| 305 | Y-2, 0.700 | 0.392 | none | AG-3 | Comparison |
| 306 | Y-2, 0.700 | 0.392 | P-1b/0.4 | AG-3 | Invention |
| 307 | Y-1, 0.915 | 0.512 | none | AG-3 | Comparison |
| 308 | Y-1, 0.915 | 0.512 | P-1b/0.2 | AG-3 | Invention |

The coatings were exposed for 0.10 s at a color temperature of 3000 K through a Wratten W98 filter and a 0–3 density 21-step tablet, and were processed through the Kodak RA-4 process, described in the British Journal of Photography Annual of 1988, Pp 198–199, comprising the following processing solutions, times and temperatures.

| Kodak RA-4 process | | |
|---|---|---|
| Developer | 0'45" | 35° C. |
| Bleach-Fix | 0'45" | 35° C. |
| Wash | 1'30" | 33–34° C. |

All of the coatings showed good color forming properties. The spectrophotometric hue of the yellow dye in each coating was measured.

Also, the blue spectral sensitivity of the coatings was measured by exposing monochromatic stepped exposures at 5 nm intervals over a wavelength range of 360 nm to 595 nm. The coatings were processed through the Kodak RA-4 process, described above. The coatings 101–108 containing comparison dispersion AG-1 all had peak spectral sensitivity near 480 nm. The coatings 201–208 containing emulsion AG-2 had peak sensitivity near 475 nm. The coatings 301–308 containing emulsion AG-3 had a peak sensitivity near 455 nm.

A three-color multilayer color paper having the following formulation was prepared:

| LAYER | COMPONENT | AMOUNT |
|---|---|---|
| 7 | ST-4 | 0.021 g/m² |
| | S-1 | 0.064 g/m² |
| | F-1 | 0.009 g/m² |
| | F-2 | 0.004 g/m² |
| | Dye-1 | 0.021 g/m² |
| | Dye-2 | 0.009 g/m² |
| | Dye-3 | 0.019 g/m² |
| | Gelatin | 1.076 g/m² |
| 6 | UV-1 | 0.048 g/m² |
| | UV-2 | 0.274 g/m² |
| | ST-4 | 0.037 g/m² |
| | S-8 | 0.108 g/m² |
| | Gelatin | 0.716 g/m² |
| 5 | AG-5 Red sensitive Ag | 0.212 g Ag/m² |
| | C-3 | 0.423 g/m² |
| | S-1 | 0.232 g/m² |
| | S-14 | 0.035 g/m² |
| | ST-4 | 0.004 g/m² |
| | Gelatin | 1.087 g/m² |
| 4 | UV-1 | 0.048 g/m² |
| | UV-2 | 0.274 g/m² |
| | ST-4 | 0.037 g/m² |
| | S-8 | 0.108 g/m² |
| | Gelatin | 0.716 g/m² |
| 3 | AG-4 Green sensitive Ag | 0.257 g Ag/m² |
| | M-1 | 0.389 g/m² |
| | S-1 | 0.195 g/m² |
| | S-14 | 0.058 g/m² |
| | ST-2 | 0.166 g/m² |
| | ST-4 | 0.039 g/m² |
| | Gelatin | 1.270 g/m² |
| 2 | ST-4 | 0.094 g/m² |
| | S-1 | 0.282 g/m² |
| | ST-14 | 0.065 g/m² |
| | F-1 | 0.002 g/m² |
| | Gelatin | 0.753 g/m² |
| 1 | AG-1 Blue sensitive Ag | 0.267 g Ag/m² |
| | Y-1 | 1.076 g/m² |
| | S-1 | 0.269 g/m² |
| | S-14 | 0.269 g/m² |
| | ST-15 | 0.009 g/m² |
| | Gelatin | 1.530 g/m² |
| Support | Polyethylene laminated paper with $TiO_2$/ZnO in the polyethylene laminated in the first layer side. | |

Bis(vinylsulfonylmethyl) ether (1.95% to total gelatin weight) was added as hardener.

Silver chloride emulsions were chemically and spectrally sensitized as described below.

AG-5 Red Emulsion: A high chloride silver halide emulsion was precipitated by equimolar addition of silver nitrate and sodium chloride solutions into a well-stirred reactor containing gelatin peptizer and thioether ripener. The resultant emulsion contained cubic shaped grains of 0.40 μm in edgelength size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium and ruthenium dopants were added during the sensitization process.

AG-4 Green Emulsion: A high chloride silver halide emulsion was precipitated by equimolar addition of silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. Iridium dopant was added during the late stage of grain formation. The resultant emulsion contained cubic shaped grains of 0.30 μm in edgelength size. This emulsion was optimally sensitized with green sensitizing dye GSD-1, a colloidal suspension of aurous sulfide, heat digestion followed by the addition of 1-(3-acetamidophenyl)-5-mercaptotetrazole and potassium bromide.

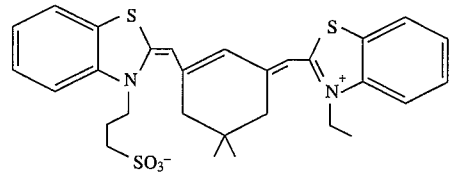

RSD-1

-continued

GSD-1

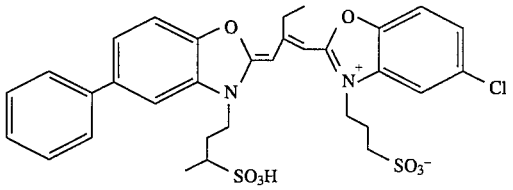

Absorber dyes used were the following:

Dye-1

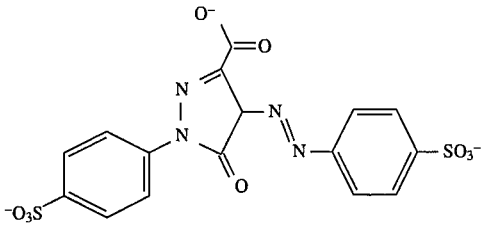

Dye-2

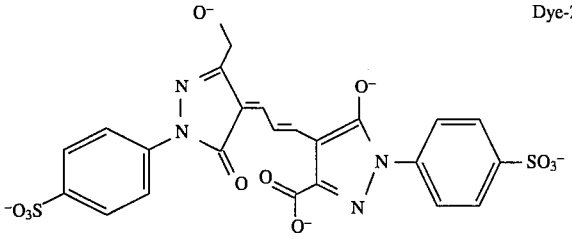

Dye-3

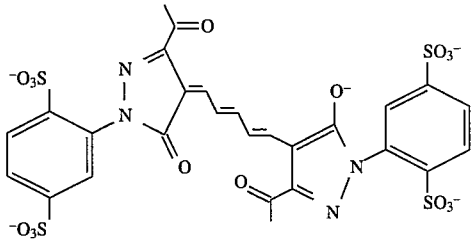

Substitution of the various yellow single layer coatings described above for the blue sensitive layer of the three-color multilayer color paper element results in the color reproduction performance indicated in Table I below. Computer modeling shows the color reproduction that occurs with such substitutions with the green- and red-sensitive layer performance modeled on the actual performance of the multilayer structure.

The colors of a MacBeth color chart are photographed with a commercially available Kodak Super™ 200 speed color negative film, which is then printed onto the color papers, maintaining neutral balance throughout the process. The relative color reproduction characteristics of the color negative film optically printed onto color papers with a peak blue layer sensitivity at 480 run as compared to the same negative printed onto color papers with peak blue sensitivities at 475 and 455 nm are determined for several color patches. The results for the yellow and green color patches are indicated in Table I. The CIELAB color space and methodology of measurement is described at "ASTM Standards on Color and Apperance Measurements", 2nd ed., ASTM, Philadelphia, 1987, at Standard E 308-85, pages 166-ff. The interpretation of CIELAB plots is described by Billmeyer and Saltzman in "Principles of Color Technology", 2nd ed. Wiley, New York, 1981, at pages 58-ff. CIELAB color space calculations show that for yellow and green colors, the combination of short blue sensitization and polymer containing dispersion leads to substantially improved color reproduction. Red and blue patches are also better reproduced by the short sensitization, with no penalty due to the presence of the polymer in the yellow coupler dispersion. Reproduction of a cyan patch is essentially unchanged in all variations.

The color reproduction of groups of six coatings (Samples 101, 201, 301, 102, 202, and 302) containing a single yellow coupler are compared. The six coatings in each case comprise three coatings each with two dispersions of the same yellow dye-forming coupler, one dispersion containing polymer and one without. The three coatings of each dispersion comprise either comparative blue sensitive emulsion AG-1, or short-blue sensitive emulsion AG-2 or AG-3, that differ only in the blue spectral sensitizing dye used in preparing the emulsion. In each group of six coatings, a relative value of 100 is assigned to the CIELAB color error, as a three-dimensional deviation from aim, with the sum of vectors of a*, b*, and L*, of the comparison coating comprising both the non-polymer containing dispersion and the peak blue sensitivity of nm, for the yellow (MCC Yellow 5Y8.5/12) and green (MacBeth Green) patches of the color chart. The corresponding color error is tabulated for the other five coatings, including the two elements of the invention in each set, with both short-blue sensitization and polymeric yellow dispersions.

TABLE I

| Sample | Coupler, Dispersion | λ, Peak | Polymer, Ratio | Yellow Error a*b*L* | Green Error a*b*L* | Comment |
|---|---|---|---|---|---|---|
| 101 | Y-3, Disp A | 480 | none | 100 | 100 | Comparison |
| 201 | Y-3, Disp A | 475 | none | 89.2 | 87.8 | Comparison |
| 301 | Y-3, Disp A | 455 | none | 81.5 | 81.8 | Comparison |
| 102 | Y-3, Disp B | 480 | P-1a, 1.0 | 90.2 | 94.5 | Comparison |
| 202 | Y-3, Disp B | 475 | P-1a, 1.0 | 77.4 | 81.2 | Invention |
| 302 | Y-3, Disp B | 455 | P-1a, 1.0 | 66.7 | 75.1 | Invention |

A projection of the above three-dimensional color errors onto the CIELab a*b* plane is also calculated, and the two-dimensional color errors are calculated excluding the L* component. In a similar manner, the color errors of the comparison coating comprising both the non-polymer containing dispersion and the peak blue sensitivity of 480 nm is assigned a relative value of 100, and the a*b* color errors of the other coatings are calculated relative to this comparison.

TABLE II

| Sample | Coupler, Dispersion | λ, Peak | Polymer, Ratio | Yellow Error a*b* | Green Error a*b* | Comment |
|---|---|---|---|---|---|---|
| 101 | Y-3, Disp A | 480 | none | 100 | 100 | Comparison |
| 201 | Y-3, Disp A | 475 | none | 83.4 | 68.5 | Comparison |
| 301 | Y-3, Disp A | 455 | none | 65.7 | 25.4 | Comparison |
| 102 | Y-3, Disp B | 480 | P-1a, 1.0 | 90.1 | 95.4 | Comparison |
| 202 | Y-3, Disp B | 475 | P-1a, 1.0 | 72.0 | 62.3 | Invention |
| 302 | Y-3, Disp B | 455 | P-1a, 1.0 | 48.6 | 10.0 | Invention |

It is apparent from the tables above that superior color reproduction is obtained from the elements of the invention that combine short-blue sensitivity with polymer containing dispersions of the invention, enabling improved hue and chromaticity in the final viewable image with respect to the actual color position for the representative color samples. True synergy is seen between the effects of the polymer in the dispersion and the short-blue sensitization. This effect can be seen both in three-dimensional color space (a*b*L*) and two-dimensional color space (a*b*). Further examples are shown below, in only three-dimensional color space.

TABLE III

| Sample | Coupler, Dispersion | λ, Peak | Polymer, Ratio | Yellow Error a*b*L* | Green Error a*b*L* | Comment |
|---|---|---|---|---|---|---|
| 101 | Y-3, Disp A | 480 | none | 100 | 100 | Comparison |
| 201 | Y-3, Disp A | 475 | none | 89.2 | 87.8 | Comparison |
| 301 | Y-3, Disp A | 455 | none | 81.5 | 81.8 | Comparison |
| 103 | Y-3, Disp C | 480 | P-15, 1.5 | 89.2 | 95.5 | Comparison |
| 203 | Y-3, Disp C | 475 | P-15, 1.5 | 76.4 | 82.3 | Invention |
| 303 | Y-3, Disp C | 455 | P-15, 1.5 | 67.7 | 76.2 | Invention |

Tables I–III above illustrate that a wide variety of polymers may be usefully incorporated in the yellow dye-forming coupler dispersions in the elements of the invention. Polymer P-1 and P-15 have very different properties, with glass transition temperatures that differ by more than 100° C., but both show the improvement in color reproduction when incorporated in the elements of the invention.

TABLE IV

| Sample | Coupler, Dispersion | λ, Peak | Polymer, Ratio | Yellow Error a*b*L* | Green Error a*b*L* | Comment |
|---|---|---|---|---|---|---|
| 101 | Y-3, Disp A | 480 | none | 100 | 100 | Comparison |
| 201 | Y-3, Disp A | 475 | none | 89.2 | 87.8 | Comparison |
| 301 | Y-3, Disp A | 455 | none | 81.5 | 81.8 | Comparison |
| 104 | Y-3, Disp D | 480 | P-1b, 1.0 | 90.2 | 94.5 | Comparison |
| 204 | Y-3, Disp D | 475 | P-1b, 1.0 | 76.9 | 81.2 | Invention |
| 304 | Y-3, Disp D | 455 | P-1b, 1.0 | 66.1 | 75.1 | Invention |

Tables I–IV above show that very similar improvements in color reproduction are seen with different methods of preparing polymer containing dispersions. In the above cases, elements containing dispersions of polymer P-1 and coupler Y-3 show very similar improvement in color reproduction, whether they are prepared by latex loading in the absence of any volatile organic solvent, or by emulsifying and dispersing an ethyl acetate solution of coupler, high-boiling solvent, and polymer, followed by evaporation of the ethyl acetate.

Two additional examples are shown below.

TABLE V

| Sample | Coupler, Dispersion | λ, Peak | Polymer, Ratio | Yellow Error a*b*L* | Green Error a*b*L* | Comment |
|---|---|---|---|---|---|---|
| 105 | Y-2, Disp E | 480 | none | 100 | 100 | Comparison |
| 205 | Y-2, Disp E | 475 | none | 88.0 | 87.1 | Comparison |
| 305 | Y-2, Disp E | 455 | none | 80.3 | 81.5 | Comparison |
| 106 | Y-2, Disp F | 480 | P-1b, 0.4 | 97.3 | 98.9 | Comparison |
| 206 | Y-2, Disp F | 475 | P-1b, 0.4 | 84.7 | 85.4 | Invention |
| 306 | Y-2, Disp F | 455 | P-1b, 0.4 | 76.0 | 79.8 | Invention |

TABLE VI

| Sample | Coupler, Dispersion | λ, Peak | Polymer, Ratio | Yellow Error a*b*L* | Green Error a*b*L* | Comment |
|---|---|---|---|---|---|---|
| 107 | Y-1, Disp G | 480 | none | 100 | 100 | Comparison |
| 207 | Y-1, Disp G | 475 | none | 87.4 | 86.9 | Comparison |
| 307 | Y-1, Disp G | 455 | none | 77.6 | 80.6 | Comparison |
| 108 | Y-1, Disp H | 480 | P-lb, 0.2 | 97.3 | 98.9 | Comparison |
| 208 | Y-1, Disp H | 475 | P-lb, 0.2 | 83.6 | 85.1 | Invention |
| 308 | Y-1, Disp H | 455 | P-lb, 0.2 | 73.2 | 78.9 | Invention |

These examples show that a variety of yellow dye-forming couplers can be used in elements of the invention. The effect of the polymer in the dispersion is less apparent in these examples than in the preceding tables, mostly because much lower levels of the polymer are used. However, the synergy between the short-blue sensitization and the polymer is still apparent, with the presence of the same level of polymer causing more improvement in the elements with short-blue sensitization than with conventional sensitivity. With increasing polymer level in the dispersion, larger effects are seen.

Example 2:

Blue sensitive emulsion AG-6 (prepared similarly to that described in U.S. Pat. No. 5,252,451, column 8, lines 55–68) was prepared in the following manner. A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.76 μm in edge-length size. This emulsion was optimally sensitized by the addition of a colloidal suspension of aurous sulfide and heat ramped up to 60° C. during which time a mixture of blue sensitizing dyes SBD-11/SBD-4 (80/20), 1-(3-acetamidophenyl)-5-mercaptotetrazole and potassium bromide were added. In addition, iridium dopant was added during the sensitization process.

Green sensitive emulsion AG-7 was prepared in the following manner. A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.30 μm in edgelength size. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole.

A dispersion of yellow dye-forming coupler Y-11 was prepared by heating Y-11 and solvent S-1 until a homogeneous solution was obtained. This liquid oil solution was emulsified in an aqueous solution containing gelatin, surfactant F-1, and latex polymer P-54. Other coupler dispersions were emulsified by methods well known to the art. The following coating examples were coated on a polyethlene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis(vinylsulfonyl methyl) ether at 1.95% of the total gelatin weight.

Coating sample 401 was prepared with the following structure.

| LAYER | COMPONENT | AMOUNT |
|---|---|---|
| 7 | Polydimethylsiloxane | 0.027 g/m$^2$ |
| | F-1 | 0.009 g/m$^2$ |
| | F-2 | 0.0026 g/m$^2$ |
| | F-12 | 0.004 g/m$^2$ |
| | Tergitol 15-S-5 ™ | 0.003 g/m$^2$ |
| | Gelatin | 1.076 g/m$^2$ |
| 6 | UV-1 | 0.028 g/m$^2$ |
| | UV-2 | 0.159 g/m$^2$ |
| | ST-4 | 0.038 g/m$^2$ |
| | S-8 | 0.073 g/m$^2$ |
| | Gelatin | 0.382 g/m$^2$ |
| 5 | AG-5 Red sensitive Ag | 0.187 g Ag/m$^2$ |
| | C-3 | 0.423 g/m$^2$ |
| | UV-2 | 0.272 g/m$^2$ |
| | S-1 | 0.415 g/m$^2$ |
| | S-14 | 0.035 g/m$^2$ |
| | ST-4 | 0.005 g/m$^2$ |
| | Potassium tolylthiosulfonate | 0.003 g/m$^2$ |
| | Potassium tolylsulfinate | 0.0003 g/m$^2$ |
| | Silver phenylmercaptotetrazole | 0.0009 g/m$^2$ |
| | Dye-3 | 0.023 g/m$^2$ |
| | Gelatin | 1.389 g/m$^2$ |
| 4 | UV-1 | 0.060 g/m$^2$ |
| | UV-2 | 0.342 g/m$^2$ |
| | ST-4 | 0.082 g/m$^2$ |
| | S-8 | 0.157 g/m$^2$ |
| | Gelatin | 0.822 g/m$^2$ |
| 3 | AG-7 Green sensitive Ag | 0.145 g Ag/m$^2$ |
| | M-2 | 0.258 g/m$^2$ |
| | S-4 | 0.620 g/m$^2$ |
| | ST-5 | 0.775 g/m$^2$ |
| | ST-4 | 0.069 g/m$^2$ |
| | 1-(3-(2-Hydroxy)benzamidophenyl)-5-mercaptotetrazole | 0.001 g/m$^2$ |
| | KCl | 0.020 g/m$^2$ |
| | BIO-1 | 0.010 mg/m$^2$ |
| | Dye-2 | 0.006 g/m$^2$ |
| | Gelatin | 1.259 g/m$^2$ |

-continued

| LAYER | COMPONENT | AMOUNT |
|---|---|---|
| 2 | ST-4 | 0.108 g/m$^2$ |
| | S-1 | 0.308 g/m$^2$ |
| | ST-14 | 0.065 g/m$^2$ |
| | Irganox 1076 ™ | 0.016 g/m$^2$ |
| | F-1 | 0.011 g/m$^2$ |
| | Gelatin | 0.753 g/m$^2$ |
| 1 | AG-6 Blue sensitive Ag | 0.253 g Ag/m$^2$ |
| | Y-11 | 0.484 g/m$^2$ |
| | P-54 | 0.900 g/m$^2$ |
| | S-1 | 0.330 g/m$^2$ |
| | KCl | 0.020 g/m$^2$ |
| | ST-15 | 0.009 g/m$^2$ |
| | Dye-1 | 0.009 g/m$^2$ |
| | Gelatin | 1.528 g/m$^2$ |
| Support | Polyethylene laminated paper with $TiO_2$/ZnO in the polyethylene laminated in the first layer side. | |

Coating sample 402 was prepared with the following structure.

| LAYER | COMPONENT | AMOUNT |
|---|---|---|
| 7 | Polydimethylsiloxane | 0.027 g/m$^2$ |
| | F-1 | 0.009 g/m$^2$ |
| | F-2 | 0.0026 g/m$^2$ |
| | F-12 | 0.004 g/m$^2$ |
| | Tergitol 15-S-5 ™ | 0.003 g/m$^2$ |
| | Gelatin | 1.076 g/m$^2$ |
| 6 | UV-1 | 0.028 g/m$^2$ |
| | UV-2 | 0.159 g/m$^2$ |
| | ST-4 | 0.038 g/m$^2$ |
| | S-8 | 0.073 g/m$^2$ |
| | Gelatin | 0.382 g/m$^2$ |
| 5 | AG-5 Red sensitive Ag | 0.187 g Ag/m$^2$ |
| | C-3 | 0.423 g/m$^2$ |
| | UV-2 | 0.272 g/m$^2$ |
| | S-1 | 0.415 g/m$^2$ |
| | S-14 | 0.035 g/m$^2$ |
| | ST-4 | 0.005 g/m$^2$ |
| | Potassium tolylthiosulfonate | 0.003 g/m$^2$ |
| | Potassium tolylsulfinate | 0.0003 g/m$^2$ |
| | Silver phenylmercaptotetrazole | 0.0009 g/m$^2$ |
| | Dye-3 | 0.023 g/m$^2$ |
| | Gelatin | 1.389 g/m$^2$ |
| 4 | UV-1 | 0.060 g/m$^2$ |
| | UV-2 | 0.342 g/m$^2$ |
| | ST-4 | 0.082 g/m$^2$ |
| | S-8 | 0.157 g/m$^2$ |
| | Gelatin | 0.822 g/m$^2$ |
| 3 | AG-7 Green sensitive Ag | 0.212 g Ag/m$^2$ |
| | M-1 | 0.423 g/m$^2$ |
| | S-4 | 0.409 g/m$^2$ |
| | S-14 | 0.069 g/m$^2$ |
| | ST-2 | 0.327 g/m$^2$ |
| | ST-4 | 0.042 g/m$^2$ |
| | 1-(3-(2-Hydroxy)benzamidophenyl)-5-mercaptotetrazole | 0.001 g/m$^2$ |
| | KCl | 0.020 g/m$^2$ |
| | BIO-1 | 0.010 mg/m$^2$ |
| | Dye-2 | 0.006 g/m$^2$ |
| | Gelatin | 1.270 g/m$^2$ |
| 2 | ST-4 | 0.108 g/m$^2$ |
| | S-1 | 0.308 g/m$^2$ |
| | ST-14 | 0.065 g/m$^2$ |
| | Irganox 1076 ™ | 0.016 g/m$^2$ |
| | F-1 | 0.011 g/m$^2$ |
| | Gelatin | 0.753 g/m$^2$ |
| 1 | AG-6 Blue sensitive Ag | 0.253 g Ag/m$^2$ |
| | Y-11 | 0.484 g/m$^2$ |
| | P-54 | 0.484 g/m$^2$ |
| | S-1 | 0.330 g/m$^2$ |
| | KCl | 0.020 g/m$^2$ |
| | ST-15 | 0.009 g/m$^2$ |
| | Dye-1 | 0.009 g/m$^2$ |
| | Gelatin | 1.528 g/m$^2$ |

-continued

| LAYER | COMPONENT | AMOUNT |
|---|---|---|
| Support | Polyethylene laminated paper with $TiO_2$/ZnO in the polyethylene laminated in the first layer side. | |

Coating samples 401 and 402 of the invention were exposed and processed in the usual manner, using the Kodak RA-4 process. Color reproduction attributes of the print materials were shown to be excellent.

Coating sample 403 is prepared with the following structure.

| LAYER | COMPONENT | AMOUNT |
|---|---|---|
| 7 | Polydimethylsiloxane | 0.027 g/m$^2$ |
| | F-1 | 0.009 g/m$^2$ |
| | F-2 | 0.0026 g/m$^2$ |
| | F-12 | 0.004 g/m$^2$ |
| | Tergitol 15-S-5 ™ | 0.003 g/m$^2$ |
| | Gelatin | 1.076 g/m$^2$ |
| 6 | UV-1 | 0.028 g/m$^2$ |
| | UV-2 | 0.159 g/m$^2$ |
| | ST-4 | 0.038 g/m$^2$ |
| | S-8 | 0.073 g/m$^2$ |
| | Gelatin | 0.382 g/m$^2$ |
| 5 | AG-5 Red sensitive Ag | 0.187 g Ag/m$^2$ |
| | C-3 | 0.423 g/m$^2$ |
| | UV-2 | 0.272 g/m$^2$ |
| | S-1 | 0.415 g/m$^2$ |
| | S-14 | 0.035 g/m$^2$ |
| | ST-4 | 0.005 g/m$^2$ |
| | Potassium tolylthiosulfonate | 0.003 g/m$^2$ |
| | Potassium tolylsulfinate | 0.0003 g/m$^2$ |
| | Silver phenylmercaptotetrazole | 0.0009 g/m$^2$ |
| | Dye-3 | 0.023 g/m$^2$ |
| | Gelatin | 1.389 g/m$^2$ |
| 4 | UV-1 | 0.060 g/m$^2$ |
| | UV-2 | 0.342 g/m$^2$ |
| | ST-4 | 0.082 g/m$^2$ |
| | S-8 | 0.157 g/m$^2$ |
| | Gelatin | 0.822 g/m$^2$ |
| 3 | AG-7 Green sensitive Ag | 0.150 g Ag/m$^2$ |
| | M-7 | 0.215 g/m$^2$ |
| | S-1 | 0.097 g/m$^2$ |
| | Di(8-methylnononyl)phthalate | 0.086 g/m$^2$ |
| | ST-8 | 0.161 g/m$^2$ |
| | ST-16 | 0.140 g/m$^2$ |
| | 1-(3-(2-Hydroxy)benzamidophenyl)-5-mercaptotetrazole | 0.001 g/m$^2$ |
| | KCl | 0.020 g/m$^2$ |
| | BIO-1 | 0.010 mg/m$^2$ |
| | Dye-2 | 0.006 g/m$^2$ |
| | Gelatin | 1.230 g/m$^2$ |
| 2 | ST-4 | 0.108 g/m$^2$ |
| | S-1 | 0.308 g/m$^2$ |
| | ST-14 | 0.065 g/m$^2$ |
| | Irganox 1076 ™ | 0.016 g/m$^2$ |
| | F-1 | 0.011 g/m$^2$ |
| | Gelatin | 0.753 g/m$^2$ |
| 1 | AG-6 Blue sensitive Ag | 0.253 g Ag/m$^2$ |
| | Y-11 | 0.484 g/m$^2$ |
| | P-54 | 0.484 g/m$^2$ |
| | S-1 | 0.330 g/m$^2$ |
| | KCl | 0.020 g/m$^2$ |
| | ST-15 | 0.009 g/m$^2$ |
| | Dye-1 | 0.009 g/m$^2$ |
| | Gelatin | 1.528 g/m$^2$ |
| Support | Polyethylene laminated paper with $TiO_2$/ZnO in the polyethylene laminated in the first layer side. | |

Coating sample 404 is prepared with the following structure.

| LAYER | COMPONENT | AMOUNT |
|---|---|---|
| 7 | Polydimethylsiloxane | 0.027 g/m$^2$ |
| | F-1 | 0.009 g/m$^2$ |
| | F-2 | 0.0026 g/m$^2$ |
| | F-12 | 0.004 g/m$^2$ |
| | Tergitol 15-S-5 ™ | 0.003 g/m$^2$ |
| | Gelatin | 1.076 g/m$^2$ |
| 6 | UV-1 | 0.028 g/m$^2$ |
| | UV-2 | 0.159 g/m$^2$ |
| | ST-4 | 0.038 g/m$^2$ |
| | S-8 | 0.073 g/m$^2$ |
| | Gelatin | 0.382 g/m$^2$ |
| 5 | AG-5 Red sensitive Ag | 0.187 g Ag/m$^2$ |
| | C-3 | 0.423 g/m$^2$ |
| | UV-2 | 0.272 g/m$^2$ |
| | S-1 | 0.415 g/m$^2$ |
| | S-14 | 0.035 g/m$^2$ |
| | ST-4 | 0.005 g/m$^2$ |
| | Potassium tolylthiosulfonate | 0.003 g/m$^2$ |
| | Potassium tolylsulfinate | 0.0003 g/m$^2$ |
| | Silver phenylmercaptotetrazole | 0.0009 g/m$^2$ |
| | Dye-3 | 0.023 g/m$^2$ |
| | Gelatin | 1.389 g/m$^2$ |
| 4 | UV-1 | 0.060 g/m$^2$ |
| | UV-2 | 0.342 g/m$^2$ |
| | ST-4 | 0.082 g/m$^2$ |
| | S-8 | 0.157 g/m$^2$ |
| | Gelatin | 0.822 g/m$^2$ |
| 3 | AG-7 Green sensitive Ag | 0.166 g Ag/m$^2$ |
| | M-11 | 0.323 g/m$^2$ |
| | S-1 | 0.485 g/m$^2$ |
| | ST-1 | 0.107 g/m$^2$ |
| | ST-4 | 0.042 g/m$^2$ |
| | 1-(3-(2-Hydroxy)benzamidophenyl)-5-mercaptotetrazole | 0.001 g/m$^2$ |
| | KCl | 0.020 g/m$^2$ |
| | BIO-1 | 0.010 mg/m$^2$ |
| | Dye-2 | 0.006 g/m$^2$ |
| | Gelatin | 1.230 g/m$^2$ |
| 2 | ST-4 | 0.108 g/m$^2$ |
| | S-1 | 0.308 g/m$^2$ |
| | ST-14 | 0.065 g/m$^2$ |
| | Irganox 1076 ™ | 0.016 g/m$^2$ |
| | F-1 | 0.011 g/m$^2$ |
| | Gelatin | 0.753 g/m$^2$ |
| 1 | AG-6 Blue sensitive Ag | 0.253 g Ag/m$^2$ |
| | Y-11 | 0.484 g/m$^2$ |
| | P-54 | 0.900 g/m$^2$ |
| | ST-6 | 0.100 g/m$^2$ |
| | S-1 | 0.330 g/m$^2$ |
| | KCl | 0.020 g/m$^2$ |
| | ST-15 | 0.009 g/m$^2$ |
| | Dye-1 | 0.009 g/m$^2$ |
| | Gelatin | 1.528 g/m$^2$ |
| Support | Polyethylene laminated paper with $TiO_2$/ZnO in the polyethylene laminated in the first layer side. | |

Samples 403 and 404 are processed in the same manner as sample 401, and exhibit excellent color reproduction attributes.

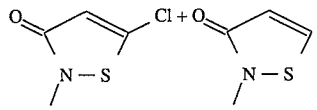

BIO-1

The invention has been described in detail with particular reference to preferred embodiments thereof, but it will be understood that variations and modifications can be effected within the spirit and scope of the invention.

What is claimed:

1. A color photographic image display material comprising a yellow dye-forming blue light sensitive silver halide emulsion layer comprising (a) a silver halide emulsion comprising greater than 90 mole % silver chloride spectrally sensitized with blue sensitizing dye providing peak blue sensitivity only at less than about 475 nm, and (b) a dispersion comprising a yellow dye-forming coupler and a water-insoluble polymer.

2. The image display material of claim 1, wherein the material comprises a support bearing said yellow dye-forming blue light sensitive silver halide emulsion layer, a magenta dye-forming green light sensitive silver halide emulsion layer, and a cyan dye-forming red light sensitive silver halide emulsion layer, and wherein the combined silver halide emulsions of the material comprise greater than 90 mole % silver chloride.

3. The image display material of claim 2, wherein the yellow dye-forming silver halide emulsion layer is spectrally sensitized with a blue sensitizing dye providing a peak blue sensitivity between about 440–475 nm.

4. The image display material of claim 3, wherein the peak blue sensitivity is between about 450–470 nm.

5. The image display material of claim 4, wherein the peak blue sensitivity is between about 450–460 nm.

6. The image display material of claim 3 wherein the silver halide emulsion of the yellow dye-forming layer comprises greater than 95 mole % silver chloride.

7. The image display material of claim 3 wherein the peak blue sensitivity is separated from the peak green layer sensitivity by greater than about 75 nanometers.

8. The image display material of claim 3 wherein the support is a reflective support.

9. The image display material of claim 1 wherein the silver halide emulsion having greater than 90 mole % silver chloride is a tabular grain silver halide emulsion having an aspect ratio greater than about 2.

10. The element of claim 1 wherein said blue sensitizing dye comprises at least one dye selected from the group consisting of:

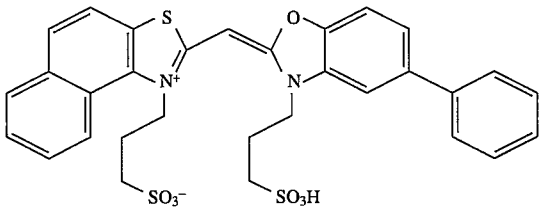

SBD-1

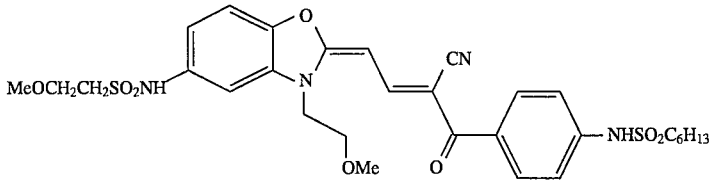

SBD-2

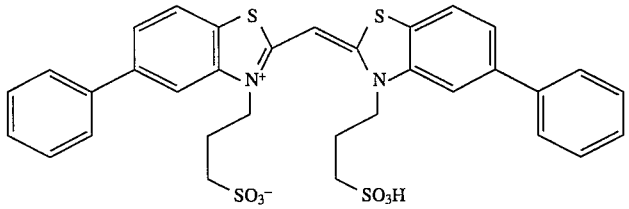

SBD-3

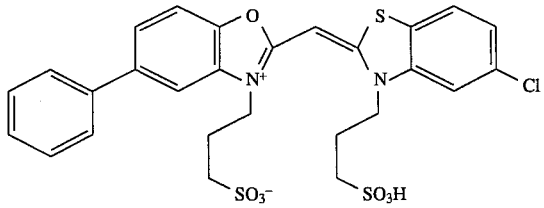

SBD-4

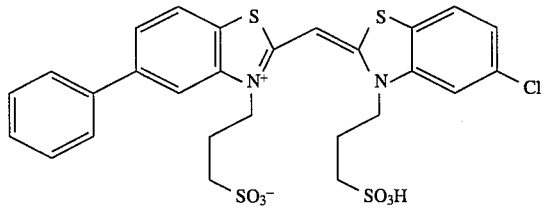

SBD-5

-continued
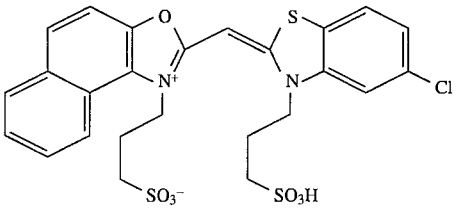
SBD-6
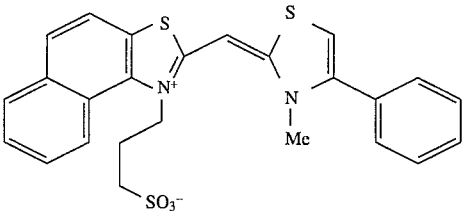
SBD-7
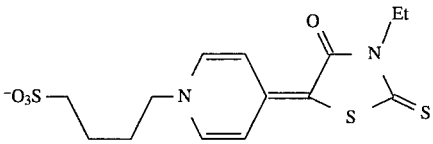
SBD-8
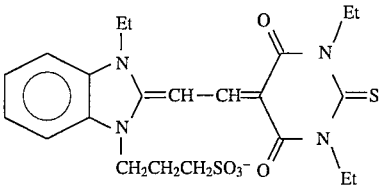
SBD-9
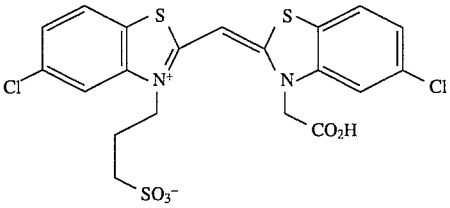
SBD-10
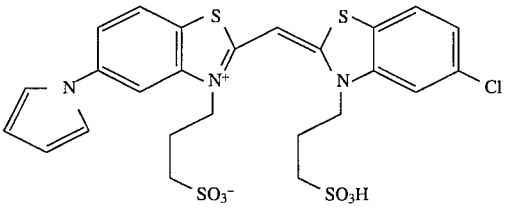
SBD-11
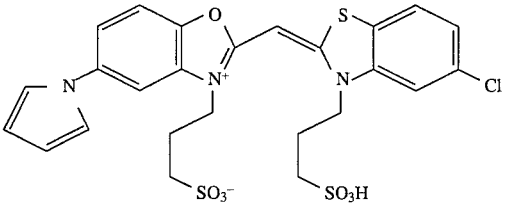
SBD-12
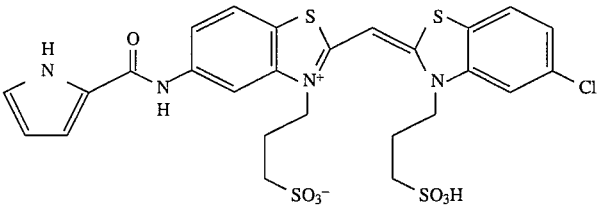
SBD-13

-continued

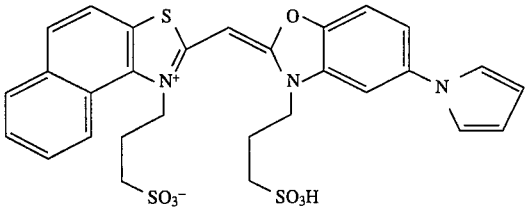

SBD-14

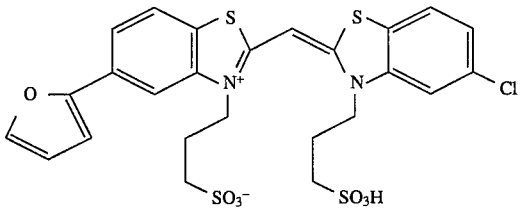

SBD-15

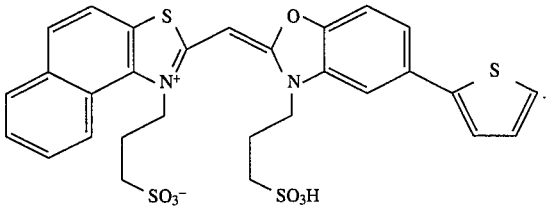

SBD-16

11. The image display material of claim 2 wherein the yellow dye-forming coupler is of the formula

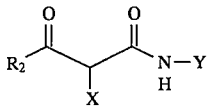

wherein X is hydrogen or a coupling-off group; Y represents an aryl group or a heterocyclic group; and $R_2$ represents an aryl or tertiary alkyl group.

12. The image display material of claim 11 wherein $R_2$ represents a tertiary alkyl group, Y represents an aryl group, and X represents an aryloxy or N-heterocyclic coupling-off group.

13. The image display material of claim 2 wherein the polymer comprises at least about 50% N-alkylacrylamide monomer units, where the alkyl substituent of the N-alkylacrylamide has from 3–8 carbon atoms.

14. The image display material of claim 2 wherein the dispersion comprising a yellow dye-forming coupler and a water-insoluble polymer comprises a loaded latex dispersion.

15. The image display material of claim 2 wherein the blue sensitive emulsion layer has a minimum speed such that a 0.8 density speed point, defined as the minimum exposure through a neutral exposure tablet having an exposure range of 0 to 3 log E which gives a density of 0.8 on the D log E characteristic curve for a 0.1 seconds exposure in a Kodak Model 1B sensitometer with a color temperature of 3000 K through a combination of a Kodak Wratten™ 2C plus a Kodak Color Compensating™ filter of 85 cc magenta plus a Kodak Color Compensating™ filter of 130 cc yellow generating an intensity of light at the exposure plane with no tablet filtration in log Lux of 3.04, is achieved at the exposure through a neutral exposure tablet which has a density of 1.4 or greater.

16. The image display material of claim 15 wherein the blue sensitive emulsion comprises a high chloride tabular grain emulsion, a high chloride tabular grain emulsion, a ruthenium doped emulsion, or a silver iodochloride emulsion having up to 2.0% iodide.

17. The image display material of claim 2 wherein the blue sensitive emulsion comprises a high chloride tabular grain emulsion, a high chloride tabular grain emulsion, a ruthenium doped emulsion, or a silver iodochloride emulsion having up to 2.0% iodide.

18. The image display material of claim 17 wherein the blue sensitive emulsion comprises a silver iodochloride emulsion having up to 2.0% iodide.

19. The image display material of claim 2 wherein the green sensitive layer comprises a substituted pyrazolotriazole or a substituted 3-aminopyrazolone magenta dye forming image coupler.

* * * * *

UNITED STATES PATENT AND TRADEMARK OFFICE

CERTIFICATE OF CORRECTION

PATENT NO. : 5,582,960

DATED : December 10, 1996

INVENTOR(S) : Ralph B. Nielsen, et al

It is certified that error appears in the above-indentified patent and that said Letters Patent is hereby corrected as shown below:

Abstract, line 5 delete "emusion" and insert therefor -- emulsion --

Column 71 delete "

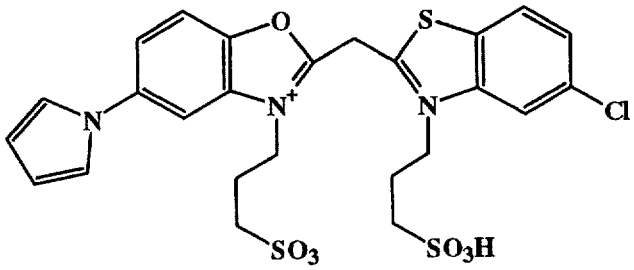

" and

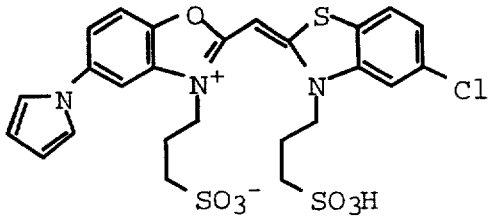

insert therefor -- --

Column 74, line 36 after "high chloride" insert therefor -- [100] --

Column 74, line 37 after "high chloride" insert therefor -- [111] --

UNITED STATES PATENT AND TRADEMARK OFFICE

CERTIFICATE OF CORRECTION

PATENT NO. : 5,582,960
DATED : December 10, 1996
INVENTOR(S) : Ralph B. Nielsen, et al It is certified that error appears in the above-indentified patent and that said Letters Patent is hereby corrected as shown below:

| | |
|---|---|
| Column 74, line 42 | after "high chloride" insert therefor -- [100] -- |
| Column 74, line 43 | after "high chloride" insert therefor -- [111] -- |

Signed and Sealed this

Nineteenth Day of August, 1997

Bruce Lehman

*Attest:*

BRUCE LEHMAN

*Attesting Officer*

*Commissioner of Patents and Trademarks*